US010837199B2

(12) United States Patent
Ou et al.

(10) Patent No.: US 10,837,199 B2
(45) **Date of Patent: *Nov. 17, 2020**

(54) CYLINDRICAL LATCH BOLT ASSEMBLY HAVING BEVELED BLOCKING SURFACE

(71) Applicant: HAMPTON PRODUCTS INTERNATIONAL CORPORATION, Foothill Ranch, CA (US)

(72) Inventors: Xinmin Ou, Zhuhai (CN); Jon Fong Quan, Fountain Valley, CA (US); Guohua Liu, Zhuhai (CN); Jian Wen, Zhuhai (CN)

(73) Assignee: Hampton Products International Corporation, Foothill Ranch, CA (US)

( * ) Notice: Subject to any disclaimer, the term of this patent is extended or adjusted under 35 U.S.C. 154(b) by 939 days.

This patent is subject to a terminal disclaimer.

(21) Appl. No.: 15/506,693

(22) PCT Filed: Sep. 5, 2014

(86) PCT No.: PCT/CN2014/086039

§ 371 (c)(1),
(2) Date: Feb. 24, 2017

(87) PCT Pub. No.: WO2016/033805

PCT Pub. Date: Mar. 10, 2016

(65) Prior Publication Data

US 2018/0058096 A1 Mar. 1, 2018

(51) Int. Cl.
*E05B 15/10* (2006.01)
*E05B 17/00* (2006.01)
(Continued)

(52) U.S. Cl.
CPC ..... *E05B 15/101* (2013.01); *E05B 15/10* (2013.01); *E05B 17/007* (2013.01);
(Continued)

(58) Field of Classification Search
CPC .... E05B 59/00; E05B 13/002; E05B 15/0205; E05B 63/18; E05C 9/047; E05C 9/041; E05C 7/06; E05C 9/043
(Continued)

(56) References Cited

U.S. PATENT DOCUMENTS 1,876,081 A 9/1932 Schlage
1,888,828 A 11/1932 Moore
(Continued)

FOREIGN PATENT DOCUMENTS

CN 1223328 7/1999
CN 1255181 5/2000
(Continued)

OTHER PUBLICATIONS

Non-Final Office Action on co-pending US application (U.S. Appl. No. 15/239,355) dated Feb. 7, 2018.
(Continued)

*Primary Examiner* — Kristina R Fulton
*Assistant Examiner* — Thomas L Neubauer
(74) *Attorney, Agent, or Firm* — Klein, O'Neill & Singh, LLP

(57) ABSTRACT

A lockset (10) is actuable by pivoting a lever (14) about a longitudinal axis of the lockset (10) by rotating the lever (14) and by pushing or pulling on the lever (14). An actuator linked to the lever extends into a retractor assembly (33) of the lockset and is configured to actuate a retractor (40) to retract a latch bolt (550) in order to enable a corresponding door (22) to be opened. The latch bolt (550) has a blocking surface (560) that is configured to engage an edge of a door strike plate (45) in order to prevent the door (22) from opening. The blocking surface (560) is inclined relative to an axis of the latch bolt (550).

21 Claims, 20 Drawing Sheets

(51) Int. Cl.

| | |
|---|---|
| ***E05B 55/00*** | (2006.01) |
| *E05B 55/12* | (2006.01) |
| *E05C 1/14* | (2006.01) |

(52) U.S. Cl.
CPC ..... *E05B 55/005* (2013.01); *E05B 55/12* (2013.01); *E05C 1/14* (2013.01)

(58) Field of Classification Search
USPC ..... 292/137, 163, 169, 169.13, 169.14, 32; 70/11
See application file for complete search history.

(56) References Cited

U.S. PATENT DOCUMENTS

| | | | | |
|---|---|---|---|---|
| 1,938,112 | A | | 12/1933 | Schlage |
| 1,965,789 | A | | 7/1934 | Anglyn |
| 1,967,152 | A | | 7/1934 | Lyons |
| 2,175,791 | A | | 10/1939 | Brauning |
| 2,267,939 | A | | 12/1941 | McKenzie |
| 2,370,646 | A | | 3/1945 | Falk |
| 2,424,782 | A | | 7/1947 | Voight et al. |
| 2,688,181 | A | | 9/1954 | Livermont et al. |
| 2,801,536 | A | | 8/1957 | Best |
| 2,862,379 | A | | 12/1958 | Schafer |
| 2,895,322 | A | | 7/1959 | Pollock |
| 3,035,432 | A | | 5/1962 | De Vines |
| 3,065,014 | A | | 11/1962 | Russell |
| 3,128,115 | A | | 4/1964 | Patriquin et al. |
| 3,161,036 | A | | 12/1964 | Himes et al. |
| 3,490,803 | A | | 1/1970 | Rollins |
| 3,495,861 | A | | 2/1970 | Snow |
| 3,518,854 | A | | 7/1970 | Krantz |
| 3,582,121 | A | | 6/1971 | Rollins |
| 3,877,263 | A | | 4/1975 | Strickler, III et al. |
| 3,899,907 | A | | 8/1975 | Prahl |
| 4,101,153 | A | | 7/1978 | Dozier |
| 4,290,282 | A | | 9/1981 | Wildenradt |
| 4,453,753 | A | | 6/1984 | Fayerman et al. |
| 4,573,334 | A | | 3/1986 | Crepinsek |
| 4,632,439 | A | | 12/1986 | Miller |
| 4,671,089 | A | | 6/1987 | Fleming et al. |
| 4,763,935 | A | | 8/1988 | Bisbing |
| 4,777,810 | A | | 10/1988 | Webster |
| 4,976,480 | A | | 12/1990 | Dixon et al. |
| 4,982,986 | A | | 1/1991 | Gressett, Jr. et al. |
| 5,026,101 | A | | 6/1991 | Dotterweich et al. |
| 5,085,474 | A | | 2/1992 | Toledo et al. |
| 5,094,486 | A | | 3/1992 | Foster |
| 5,157,953 | A | | 10/1992 | Hung |
| 5,301,526 | A | | 4/1994 | Fann et al. |
| 5,322,333 | A | | 6/1994 | Norton, II et al. |
| 5,364,139 | A | | 11/1994 | Bergen et al. |
| 5,460,419 | A | | 10/1995 | Castoldi |
| 5,469,725 | A | | 11/1995 | Yamada |
| 5,481,890 | A | | 1/1996 | Millman |
| 5,516,163 | A | | 5/1996 | Baker |
| 5,533,368 | A | | 7/1996 | Eagan |
| 5,605,064 | A | | 2/1997 | Katayama et al. |
| 5,727,406 | A | | 3/1998 | Banducci |
| 5,761,936 | A | | 6/1998 | Kayayama |
| 5,921,117 | A | | 7/1999 | Illguth |
| 5,934,117 | A | | 8/1999 | Shen |
| 5,947,535 | A | | 9/1999 | Baker |
| 5,947,537 | A | | 9/1999 | Aigner et al. |
| 5,983,683 | A | | 11/1999 | Shen |
| 6,035,492 | A | | 3/2000 | Warshaviak |
| 6,131,970 | A | | 10/2000 | Hurst et al. |
| 6,141,998 | A | * | 11/2000 | Seo ..... E05B 1/0092 70/224 |
| 6,223,572 | B1 | | 5/2001 | Marttinen |
| 6,279,360 | B1 | | 8/2001 | Shen |
| 6,302,457 | B1 | | 10/2001 | Shen |
| 6,322,113 | B1 | | 11/2001 | Ayers et al. |
| 6,354,119 | B1 | | 3/2002 | Molzer |
| 6,360,569 | B1 | | 3/2002 | Huang |
| 6,364,383 | B1 | | 4/2002 | Shen |
| 6,386,602 | B1 | | 5/2002 | Lan |
| 6,553,799 | B2 | | 4/2003 | Bates et al. |
| 6,619,710 | B1 | | 9/2003 | Hwang |
| 6,802,194 | B1 | | 10/2004 | Shen |
| 6,868,705 | B2 | | 3/2005 | Miao |
| 6,997,024 | B2 | | 2/2006 | Etlicher |
| 7,100,406 | B2 | | 9/2006 | Masseth, Jr. |
| 7,100,407 | B2 | | 9/2006 | Chen |
| 7,712,343 | B2 | | 5/2010 | Smith et al. |
| 8,240,177 | B2 | | 8/2012 | Baser |
| 8,449,003 | B2 | | 5/2013 | Bunker, II et al. |
| 8,505,345 | B2 | | 8/2013 | Sun et al. |
| 8,690,205 | B2 | | 4/2014 | Benitez et al. |
| 8,813,530 | B2 | | 8/2014 | Chiou et al. |
| 8,833,120 | B2 | | 9/2014 | Collins et al. |
| 9,121,200 | B2 | | 9/2015 | Weathersby |
| 9,212,507 | B2 | | 12/2015 | Ou et al. |
| 9,371,671 | B2 | | 6/2016 | Weathersby |
| 9,447,610 | B2 | | 9/2016 | Ou et al. |
| 9,556,644 | B2 | | 1/2017 | Yoon et al. |
| 10,240,362 | B2 | * | 3/2019 | Ou ..... E05B 13/10 |
| 2002/0100301 | A1 | | 8/2002 | Eller et al. |
| 2002/0104345 | A1 | | 8/2002 | Wang |
| 2003/0037582 | A1 | | 2/2003 | Edwards, Jr. et al. |
| 2003/0056556 | A1 | | 3/2003 | Park et al. |
| 2003/0121300 | A1 | | 7/2003 | Wang |
| 2005/0126236 | A1 | | 6/2005 | Romero |
| 2006/0079294 | A1 | | 4/2006 | Chen |
| 2006/0185409 | A1 | | 8/2006 | Sun et al. |
| 2006/0214436 | A1 | | 9/2006 | Wheatland et al. |
| 2007/0096479 | A1 | | 5/2007 | Lin et al. |
| 2008/0168809 | A1 | | 7/2008 | Liu et al. |
| 2008/0307836 | A1 | | 12/2008 | Kim et al. |
| 2009/0078011 | A1 | | 3/2009 | Avni |
| 2009/0152875 | A1 | | 6/2009 | Gray et al. |
| 2009/0288459 | A1 | | 11/2009 | Liu et al. |
| 2010/0139335 | A1 | | 6/2010 | Constantinou |
| 2010/0307207 | A1 | | 12/2010 | Vogel et al. |
| 2011/0225770 | A1 | | 9/2011 | Alber |
| 2011/0289987 | A1 | | 12/2011 | Chiou et al. |
| 2012/0212001 | A1 | | 8/2012 | Benitez et al. |
| 2012/0267907 | A1 | | 10/2012 | Rudhager et al. |
| 2013/0200636 | A1 | | 8/2013 | Hagemeyer et al. |
| 2013/0269402 | A1 | | 10/2013 | Vasudevan |
| 2014/0157843 | A1 | | 6/2014 | Quan et al. |
| 2014/0265376 | A1 | | 9/2014 | Walls et al. |

FOREIGN PATENT DOCUMENTS

| | | | |
|---|---|---|---|
| CN | 2430511 | | 5/2001 |
| CN | 2559730 | | 7/2003 |
| CN | 2641228 | | 9/2004 |
| CN | 2658315 | | 11/2004 |
| CN | 2693906 | | 4/2005 |
| CN | 101006240 | | 7/2007 |
| CN | 201695763 | U | 1/2011 |
| CN | 102758561 | | 10/2012 |
| CN | 102777073 | | 11/2012 |
| CN | 202755736 | U | 2/2013 |
| CN | 202788202 | U | 3/2013 |
| CN | 202788218 | U | 3/2013 |
| CN | 203308188 | U | 11/2013 |
| CN | 203403726 | U | 1/2014 |
| EP | 1679414 | | 7/2006 |
| EP | 2505750 | | 10/2012 |
| JP | 2013209805 | | 10/2013 |
| TW | M246397 | U | 10/2004 |
| TW | M271068 | U | 7/2005 |
| TW | M434811 | U | 8/2012 |
| TW | M461676 | U | 9/2013 |

(56) References Cited

FOREIGN PATENT DOCUMENTS

| | | |
|---|---|---|
| WO | WO2016033793 | 3/2016 |
| WO | WO2016033804 | 3/2016 |

OTHER PUBLICATIONS

Non-Final Office Action on co-pending US application (U.S. Appl. No. 15/506,690) dated Jun. 11, 2018.
Notice of Allowance on co-pending US application (U.S. Appl. No. 15/239,055) dated Aug. 30, 2018.
Office Action on co-pending Canadian patent application (CA 2959251) dated Feb. 16, 2018.
Office Action on co-pending Canadian patent application (CA 2959255) dated Jan. 18, 2018.
International Search Report on corresponding PCT application (PCT/CN2014/086039) from International Searching Authority (SIPO) dated Jun. 4, 2015.
Written Opinion on corresponding PCT application (PCT/CN2014/086039) from International Searching Authority (SIPO) dated Jun. 4, 2015.
Non-Final Office Action on co-pending US application (U.S. Appl. No. 13/909,433) dated Dec. 8, 2014.
Notice of Allowance on co-pending US application (U.S. Appl. No. 13/909,433) dated Apr. 28, 2015.
Office Action on co-pending US application (U.S. Appl. No. 14/027,916) dated May 11, 2015.
Non-Final Office Action on co-pending US application (U.S. Appl. No. 14/809,019) dated Sep. 14, 2015.
Notice of Allowance on co-pending US application (U.S. Appl. No. 14/027,972) dated Oct. 7, 2015.
Final Office Action on co-pending US application (U.S. Appl. No. 14/027,916) dated Dec. 2, 2015.
Notice of Allowance on co-pending US application (U.S. Appl. No. 14/809,019) dated Mar. 17, 2016.
Notice of Allowance on co-pending US application (U.S. Appl. No. 14/027,916) dated Jun. 23, 2016.
Office Action on corresponding foreign application (CA Application No. 2821533) from the Canadian Intellectual Property Office dated Feb. 1, 2017.
International Search Report on corresponding PCT application (PCT/CN2014/086038) from International Searching Authority (SIPO) dated May 28, 2015.
Written Opinion on corresponding PCT application (PCT/CN2014/086038) from International Searching Authority (SIPO) dated May 28, 2015.
International Search Report on corresponding PCT application (PCT/CN2014/085987) from International Searching Authority (SIPO) dated May 28, 2015.
Written Opinion on corresponding PCT application (PCT/CN2014/085987) from International Searching Authority (SIPO) dated May 28, 2015.
Notice of Allowance on co-pending US application (U.S. Appl. No. 14/933,364) dated Mar. 27, 2018.
Non-Final Office Action on co-pending US application (U.S. Appl. No. 14/933,364) dated Dec. 14, 2017.

* cited by examiner

CYLINDRICAL LATCH BOLT ASSEMBLY HAVING BEVELED BLOCKING SURFACE

CROSS-REFERENCE TO RELATED APPLICATIONS

This application is the national phase entry, under 35 U.S.C. Section 371(c), of International Application No. PCT/CN2014/086039, filed Sep. 5, 2014. The disclosure of the International Application from which this application claims priority is incorporated herein by reference in its entirety.

FEDERALLY SPONSORED RESEARCH OR DEVELOPMENT

Not Applicable

BACKGROUND

The present disclosure relates to the field of locksets for doors.

Door locksets employing levers to actuate a latch bolt upon rotation of the lever have been available for years. More recently, locksets have been developed in which the latch bolt is actuated not only by rotation of the levers, but also upon pushing or pulling a lever arm.

Although such locksets still perform the function of actuating a latch bolt, such locksets function quite differently than traditional lockset designs, and also employ different and complex structures. As such, structures traditionally used for features such as privacy locks or other types of locking mechanisms do not necessarily work well with the improved locksets. Previous designers have been unsuccessful in designing reliable and cost-effective privacy locks and keyed security locks that are disposed axially within the lever and which work well with the improved locksets.

SUMMARY

There is a need in the art for a lockset having lever actuators that actuate the latch bolt upon rotation of a lever and/or upon pushing or pulling on a lever arm, but which also provide for a privacy lock and keyed security lock that are axially incorporated into the levers of the lockset.

In accordance with one embodiment, a lockset is provided, comprising a retractor assembly configured to be fit within a door mount hole and configured to be operably coupled to a latch bolt assembly and to selectively retract a latch bolt of the latch bolt assembly. An actuator mechanism is configured to receive an actuating input when a lever rotates about an axis of the retractor assembly or when the lever pivots about an axis transverse to the axis of the retractor assembly. A keyed lock cylinder is axially arranged in the lever, configured to pivot with the lever, and comprises a receiver with an opening. A lock actuator extends into the retractor assembly and is configured to perform a locking or unlocking function when actuated. A proximal portion of the lock actuator extends through the opening and into the receiver. The receiver is configured to pivot with the lever and when the receiver pivots, the proximal portion of the lock actuator is retained within the receiver, but the lock actuator does not pivot with the receiver.

In another embodiment, the proximal portion of the lock actuator has a flared portion having a first width and a neck portion adjacent to and distal of the flared portion, the neck portion having a second width that is less than the first width.

In yet another embodiment, the receiver pivots about an axis aligned with the flared portion.

In other embodiments, the receiver is tubular and terminates at an opening, and wherein the flared portion of the lock actuator is spaced a distance from the opening so that the opening is aligned with the neck portion.

In another embodiment, the keyed lock cylinder is configured to receive a key and the receiver of the keyed lock cylinder is configured to rotate with the key, wherein the receiver comprises a guide that engages the flared portion of the lock actuator so that the lock actuator rotates with the key and receiver.

In one embodiment, the lock actuator comprises an actuator member that extends radially outwardly from an axis of the lock actuator, and wherein rotating the key causes the actuator member to urge a retractor of the retractor assembly to translate.

In another embodiment, a spring is coupled to the lever to return the lever to an original position after the lever is pivoted.

In yet another embodiment, an additional lever and an additional lock actuator coupled to the retractor assembly and configured to perform a locking function when actuated, wherein the additional lock actuator is received in the additional lever and pivots with the lever about the axis transverse to the axis of the retractor assembly.

In accordance with another embodiment, a lockset is provided, comprising a retractor assembly configured to be fit within a door mount hole and configured to be operably coupled to a latch bolt assembly and to selectively retract a latch bolt of the latch bolt assembly. An actuator mechanism of the retractor assembly configured to receive an actuating input when a first or a second lever rotates about an axis of the retractor assembly or when the first or second lever pivots about an axis transverse to the axis of the retractor assembly. The actuator mechanism causes a retractor of the retractor assembly to move in response to the actuating input. A first lock actuator configured to move between a locked and an unlocked position, wherein when in the locked position a locking member of the first lock actuator interferes with the actuator mechanism. The first lock actuator is actuable by a first mechanism that is supported with and pivots with the first lever. A second lock actuator configured to selectively trigger the first lock actuator to be moved from the locked position to the unlocked position, the second lock actuator being actuable by a second mechanism that is supported with and pivots with the second lever.

In another embodiment, one of the first and second mechanisms is a push-button configured to urge its respective one of the first and second lock actuators axially when pushed.

In yet another embodiment, the push-button has a distal end positioned to selectively engage a proximal end of its respective one of the first and second lock actuators.

In still yet another embodiment, one of the first and second mechanism comprises a rotator guide that, when rotated, engages and rotates its respective one of the first and second lock actuators.

In other embodiments, the locket additionally comprises a keyed lock cylinder comprising the rotator guide, the keyed lock cylinder accepting a key and configured to rotate with the key.

In one embodiment, the first mechanism is the rotator guide and the second mechanism is the push-button. In another embodiment, the first mechanism is the push-button, and the second mechanism is a rotator guide that, when rotated, engages and rotates the second lock actuator.

In another embodiment, the latch bolt comprises a blocking surface, the blocking surface being configured to engage an edge of a door strike plate to prevent the door from opening, wherein at least a portion of the blocking surface is inclined relative to an axis of the latch bolt.

In yet another embodiment, the blocking surface is flat.

In still another embodiment, the blocking surface is arcuate, and a slope of the blocking surface relative to the axis increases moving toward a tip of the latch bolt.

In other embodiments, the latch bolt further comprises a cam surface adjacent the blocking surface.

In one embodiment, a base portion of the blocking surface has a slope of zero relative to the axis.

In another embodiment, a dead latch trigger slidably extends adjacent the latch bolt and configured to engage the edge of the door strike plate to prevent the door from opening.

In accordance with yet another embodiment, a lockset is provided, having a retractor assembly and a latch bolt assembly. The retractor assembly is configured to be fit within a mount hole of a door. The latch bolt assembly comprises a latch bolt and a housing. The latch bolt is biased relative to the housing so that a distal portion of the latch bolt extends out of the housing when the latch bolt is in an at-rest position. A retractor of the retractor assembly is configured to be operably coupled to the latch bolt so that when the retractor is actuated to move from an unactuated position to an actuated position the latch bolt is retracted from the at-rest position into the housing of the latch bolt assembly. An actuator mechanism is operatively coupled to a handle, and is configured to actuate the retractor upon receiving an actuating input from the handle. The distal portion of the latch bolt comprises a blocking surface configured to engage an edge of a door strike plate when the door is in a closed position so as to block the door from opening. At least a portion of the blocking surface is inclined relative to an axis of the latch bolt.

In some embodiments, the at least a portion of the blocking surface is arcuate relative to the axis. In further embodiments, a slope of the blocking surface relative to the axis increases moving toward a distal tip of the latch bolt. In yet further embodiments a proximal portion of the blocking surface has a slope of zero relative to the axis.

In additional embodiments the at least a portion of the blocking surface is flat. In other such embodiments another portion of the blocking surface is arcuate. In still other such embodiments a first portion of the blocking surface has a first slope relative to the axis, and a second portion of the blocking surface has a second slope relative to the axis, the second slope being greater than the first slope. In yet additional embodiments the second portion can be disposed between the first portion and a distal tip of the blocking surface.

In another embodiment the latch bolt assembly further comprises a dead latch assembly configured to selectively prevent the latch bolt from being retracted into the housing. The dead latch assembly is configured to be in an engaged position when the door is in the closed position, and is configured to remain in the engaged position as the retractor is actuated to move from an unactuated position to a threshold position so that the latch bolt is not retracted as the retractor moves from the unactuated position to the threshold position.

In some such embodiments the dead latch assembly is further configured to move to a disengaged position once the retractor moves past the threshold position so that the latch bolt is retracted with the retractor as the retractor moves from the threshold position towards the actuated position.

Another embodiment additionally comprises a lock actuator within the retractor assembly. The lock actuator is movable between a locked position and an unlocked position. The retractor assembly is configured so that when the lock actuator is in the locked position the retractor is constrained between the unactuated position and a lock limited position.

In further embodiments, a distance between the unactuated position and the threshold position is greater than the distance between the unactuated position and the lock limited position.

In some embodiments the actuator mechanism is configured to actuate the retractor upon receiving a rotational actuating input from the handle. In additional embodiments the actuator mechanism is also configured to actuate the retractor upon receiving an axially-directed input that is directed along an axis of the actuator mechanism. In some such embodiments the axially-directed input is communicated from the handle to the actuator mechanism. In further embodiments the handle comprises a lever.

In some embodiments the actuator mechanism is configured to actuate the retractor upon receiving an axially-directed input that is directed along an axis of the actuator mechanism.

In still other embodiments the actuator mechanism is further configured to actuate the retractor upon receiving an input that is directed transverse to an axis of the actuator mechanism.

BRIEF DESCRIPTION OF THE DRAWINGS

FIG. 12 shows an end view of selected components taken along lines 12-12 of

FIG. 8;

DETAILED DESCRIPTION

Figure 1B:
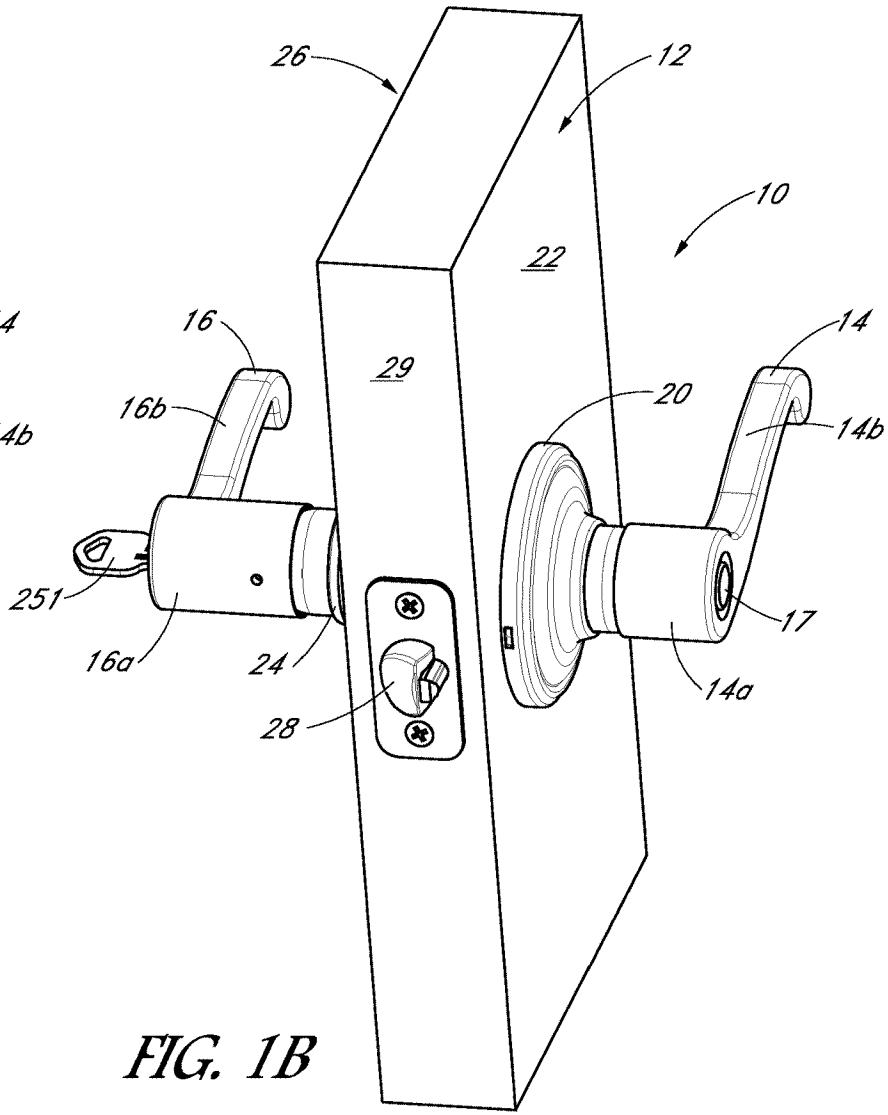
FIG. 1B shows the assembly of FIG. 1A when a privacy button is actuated.
Figure 1A:
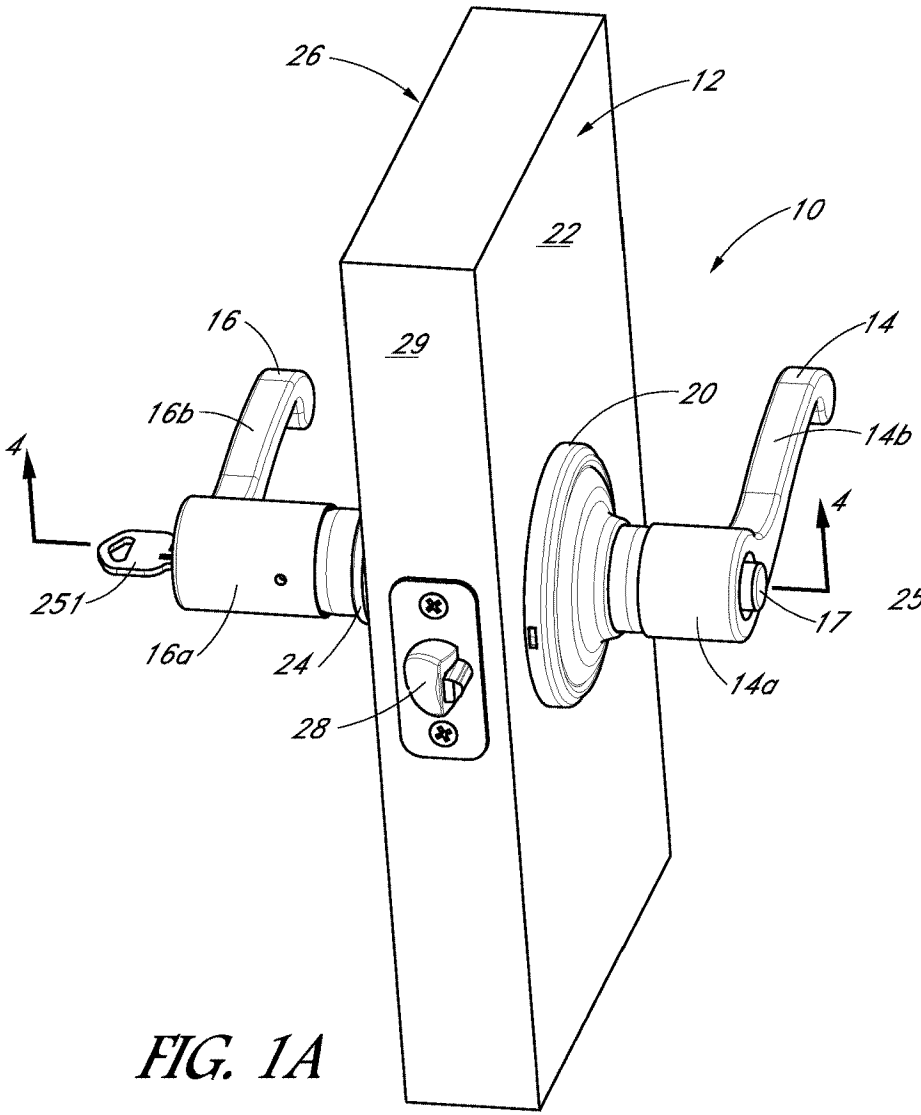
FIG. 1A shows a perspective view of a lockset in accordance with the present disclosure installed in a door.

FIG. 1A shows a perspective view of a lockset 10, in accordance with a preferred embodiment of the present disclosure, installed on a door 12. The illustrated lockset 10 has an inside lever 14 and an outside lever 16. Each of the levers 14, 16 can have a lever body 14*a*, 16*a* and a lever arm 14*b*, 16*b* that extends from the body portion 14*a*, 16*a*. The levers 14, 16 can be any shape or be any handle. A lock actuator button 17 can be arranged axially in the inside lever 14. The lock actuator button 17 is shown in a depressed, "locked" position in FIG. 1B. In another embodiment, the lock actuator button 17 can be turned to a "locked" and "unlocked" position. A keyed lock cylinder 250 can be arranged axially in the outside lever 16 (see FIG. 3).

An inside cover plate 20 or inside rose 20, is adjacent an inside surface 22 of the door, and an outside cover plate 24, or outside rose 24, is adjacent an outside surface 26 of the door 12. With additional reference to FIGS. 2 and 3, the inside and outside roses 20, 24 each cover a respective inside and outside mounting plate 46, 44 engaging the door 12 (see FIG. 3). A latch bolt 28 of a latch bolt assembly 36 extends from an edge surface 29 of the door 12 in a conventional manner.

Figure 1D:
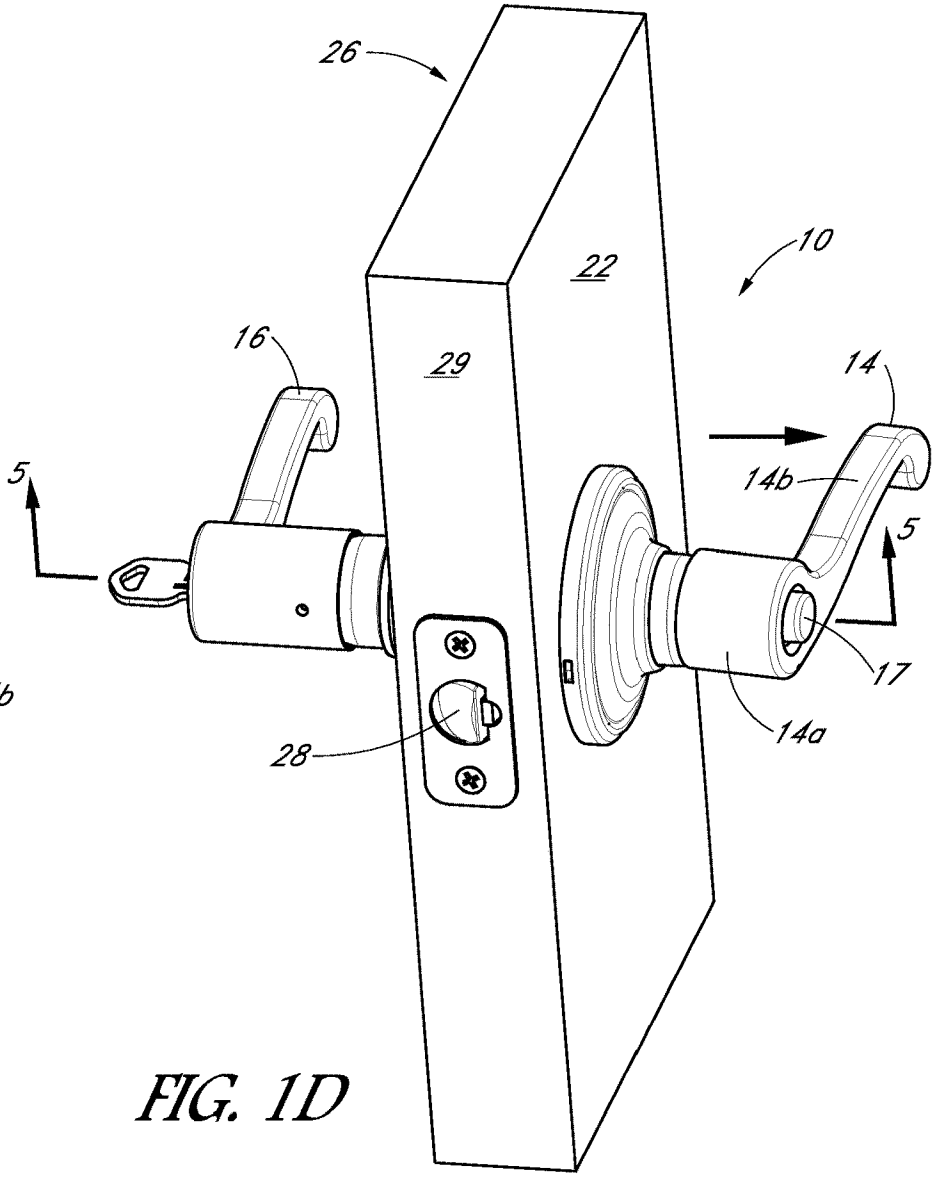
FIG. 1D shows the assembly of FIG. 1A in a configuration in which a latch bolt of the lockset has been retracted by pulling on a lever of the lockset.
Figure 1C:
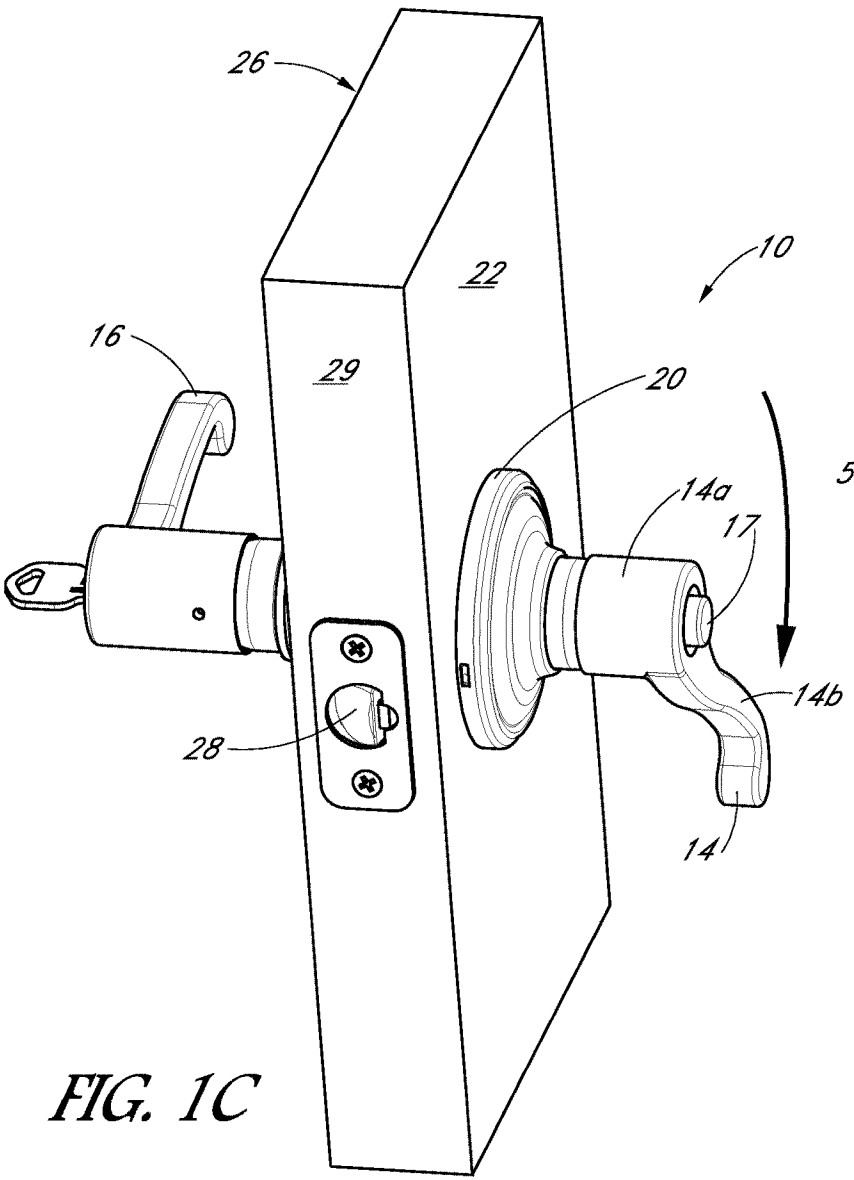
FIG. 1C shows the assembly of FIG. 1A in a configuration in which a latch bolt of the lockset has been retracted by rotating a lever of the lockset.
Figure 1F:
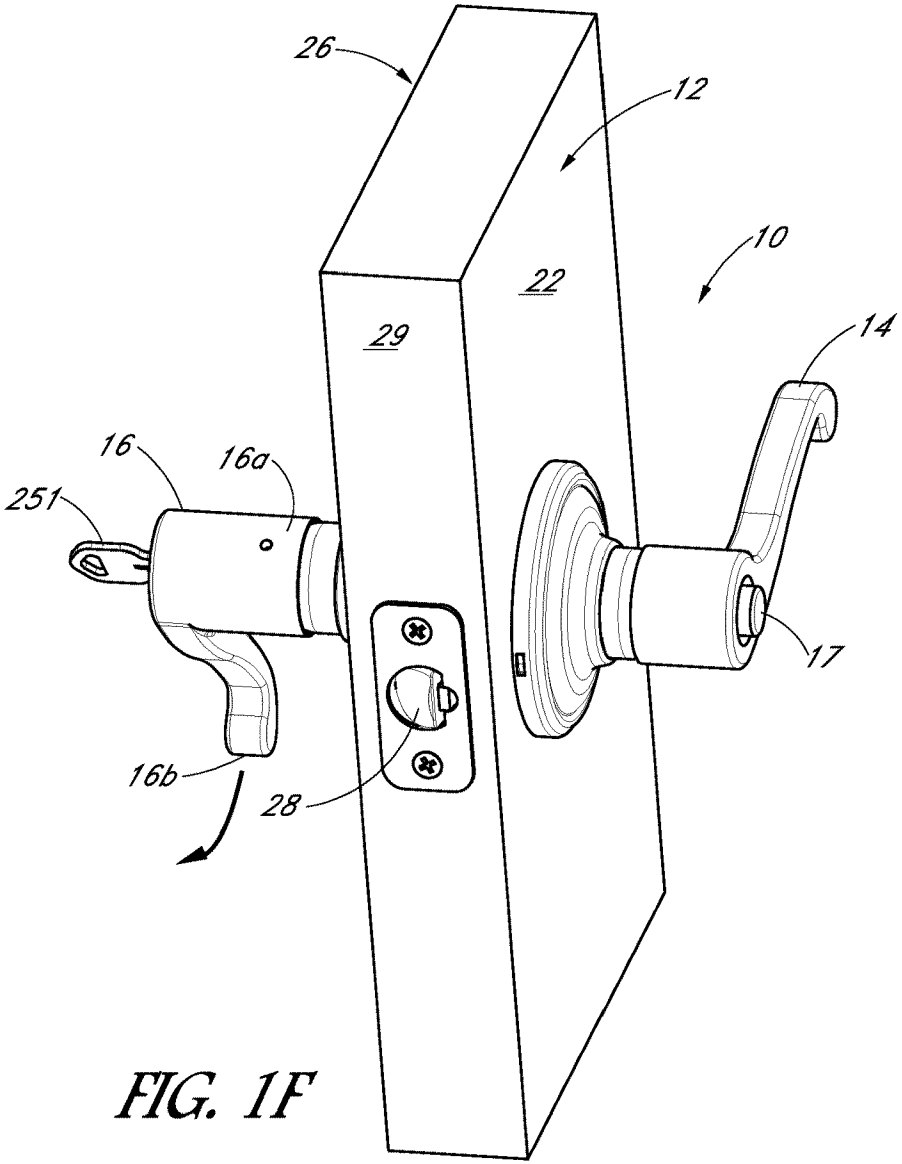
FIG. 1F shows the assembly of FIG. 1A in a configuration in which a latch bolt of the lockset has been retracted by rotating a keyed lock lever of the lockset.

With reference next to FIG. 1C, the inside lever 14 is shown being rotated about an axis of the lockset 10, as the user pushes the lever arm 14*b* downwardly. As shown, such rotation actuates the lockset 10 so as to retract the latch bolt 28. It is to be understood that an upward rotation of the lever arm 14*b* will similarly actuate the lockset 10 so as to retract the latch bolt 28. Similarly, and with reference to FIG. 1F, rotation of the outside lever 16 similarly actuates the lockset 10 so as to retract the latch bolt 28.

Figure 1E:
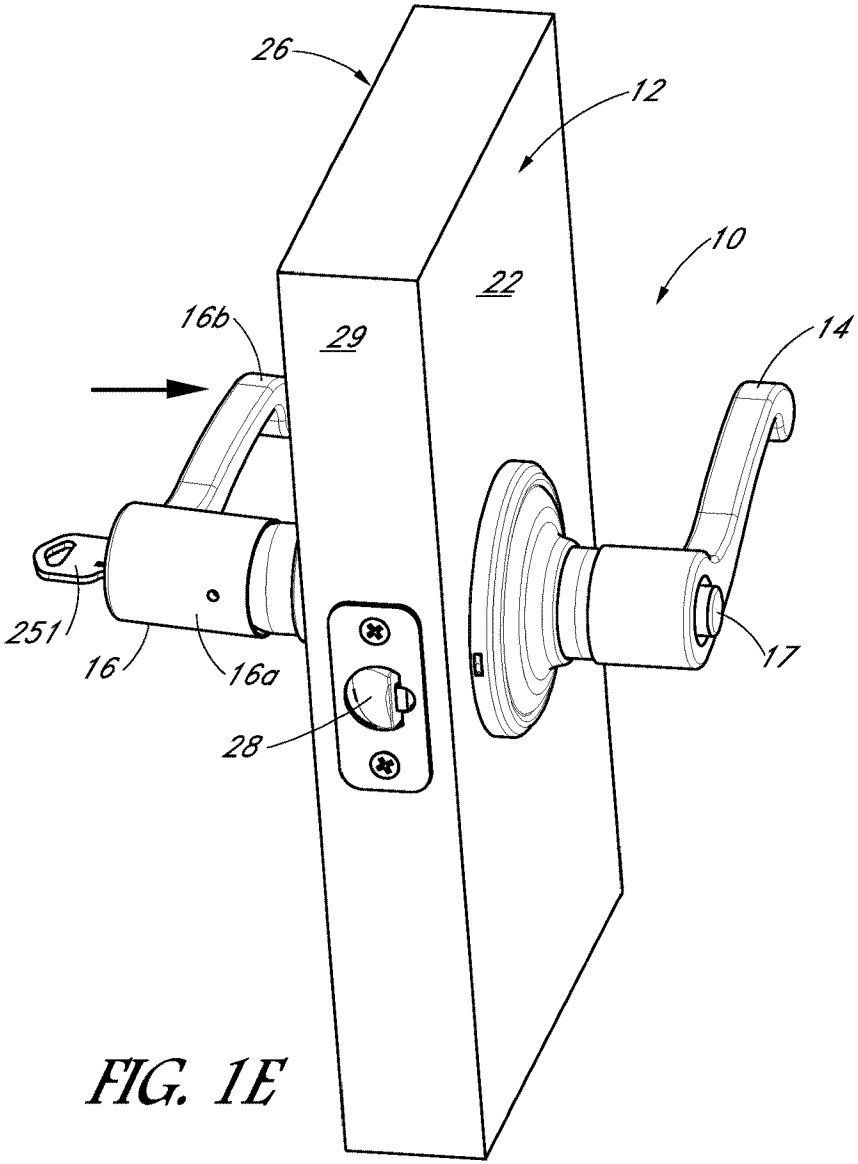
FIG. 1E shows the assembly of FIG. 1A in a configuration in which a latch bolt of the lockset has been retracted by pushing on a keyed lock lever of the lockset.

With reference next to FIG. 1D, a configuration is shown in which the inside lever arm 14*b* has been pulled away from the door 12, thus causing the inside lever 14 to pivot about an axis transverse to the axis of the lockset 10. Similarly, FIG. 1E shows the outside lever arm 16*b* being pushed toward the door 12, thus causing the outside lever 16 to pivot about an axis transverse to the axis of the lockset 10. As shown, such pivoting also actuates the lockset 10 so as to retract the latch bolt 28.

Figure 2:
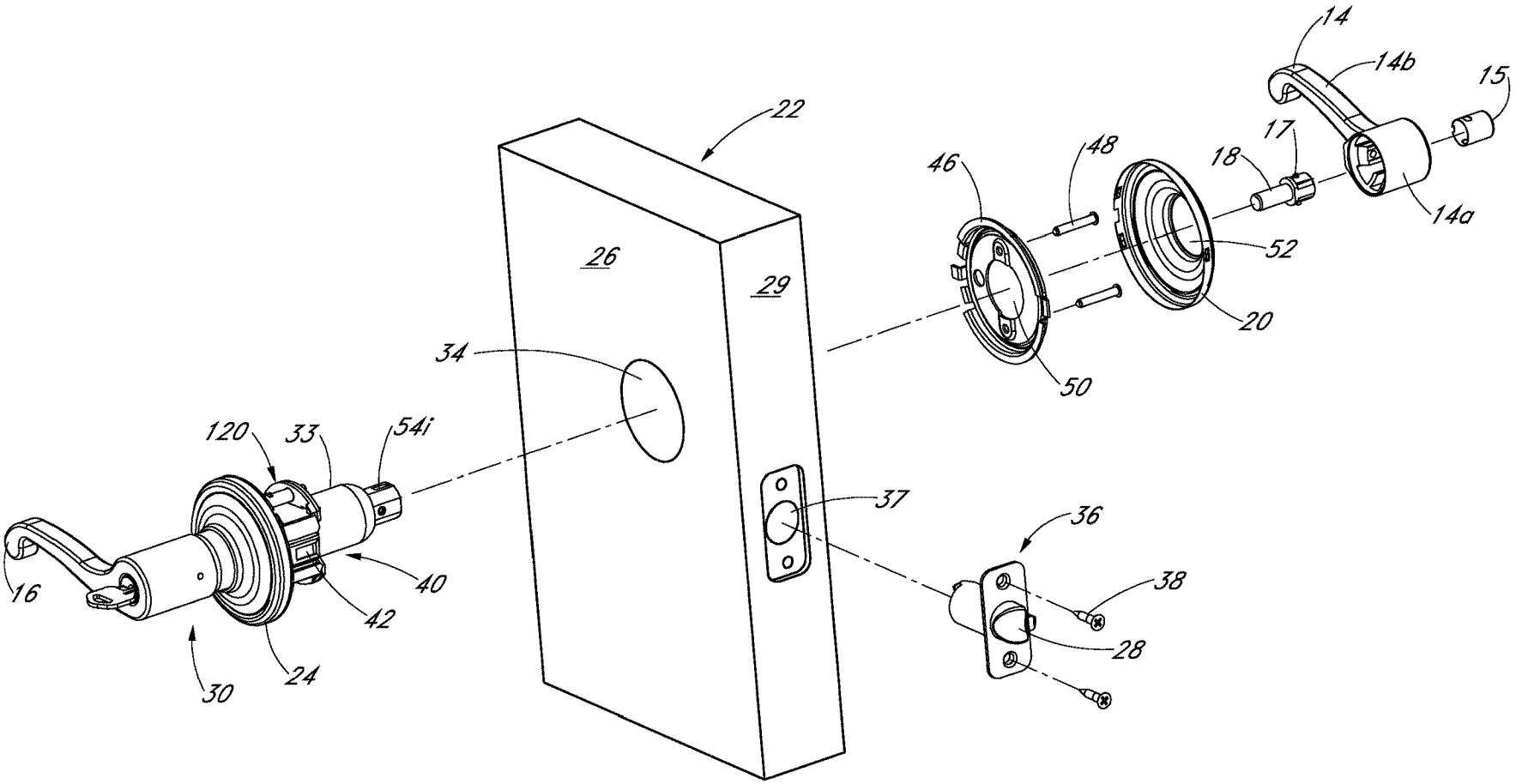
FIG. 2 shows a partially exploded perspective view of the assembly of FIG. 1A.

With reference next to FIG. 2, the lockset 10 preferably comprises an outside lever assembly 30 that may, in some embodiments, be provided preassembled when the lockset 10 is provided to installers and consumers. As shown, the outside lever assembly 30 includes the outside lever 16, outside rose 24, and a retractor assembly 33. The retractor assembly 33 extends through the outside rose 24 and is connected to the outside lever 16. The retractor assembly 33 also fits through a door mount hole 34. The latch bolt assembly 36 having the latch bolt 28 fits through a door latch bolt hole 37 and can be held in place by screws 38. A retractor 40 of the retractor assembly 33 has a latch receiver slot 42 that engages the latch bolt assembly 36 so that movement of the retractor 40 also moves the latch bolt 28, such as retracting the latch bolt 28. The retractor assembly 33 can have an axis coinciding with the axis of the lockset 10.

Figure 3:
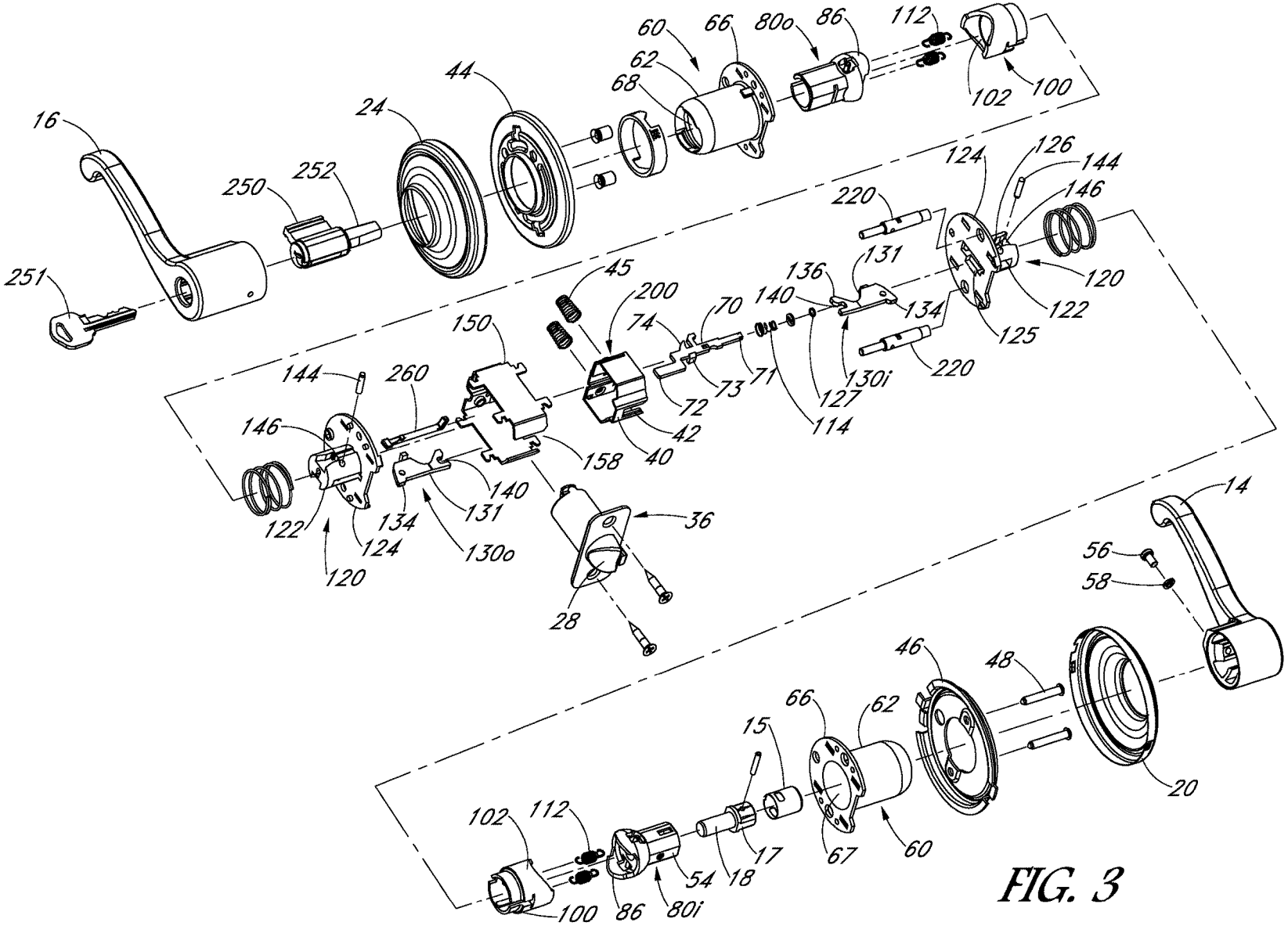
FIG. 3 shows an exploded perspective view of a retractor assembly of a lockset in accordance with an embodiment of the present disclosure.

The outside lever assembly 30 is fit through the door mount hole 34 so that the outside rose 24 (which may be integrally or releasably connected to an outside mounting plate 44 as shown in FIG. 3) engages the outside surface 26 of the door 12. An inside mounting plate 46 engages the inside surface 22 of the door, and mounting bolts 48 engage the retractor assembly 33 so that the door 12 is sandwiched between the inside rose 20 or inside mounting plate 46 and the outside rose 24 or mounting plate 44. The inside rose 20 can be attached to the inside mounting plate 46. A portion of the retractor assembly 33 extends through an inside mount plate aperture 50 defined in the inside mounting plate 46 and an inside rose aperture 52 defined in the inside rose 20. The body 14*a* of the inside lever 14 is fit onto an inside lever connector 54*i* of the retractor assembly 33, and a lever bolt 56 and lock washer 58 can hold the inside lever 14 in place (see FIG. 3). The lock actuator button 17 comprises an elongated portion 18 that terminates in a distal end. A proximal end of the lock actuator button 17 is configured to accept a decorative button cap 15 thereon.

There are several styles and designs for locksets 10, and it is anticipated that other structures can be employed than are specifically illustrated in the drawings. For example, some embodiments may not employ an inside cover plate 20, or rose, and in some embodiments the inside cover plate 20 may be connected to the inside mounting plate 46 by, for example, an interference fit between the circumference of the inside mounting plate 46 and a mating inside surface of the inside cover plate 20. In other embodiments, a leaf spring may be dimensioned and located to exert a force to the inside diameter of the inside cover plate 20 to retain it in place. In further embodiments, the inside mounting plate 46 and the inside cover plate 20 may be formed as a single, unitary component. Further, the inside and outside cover plates 20, 24 can have various decorative shapes and sizes.

FIG. 3 shows an exploded perspective view of the retractor assembly 33 of the lockset 10 and its major components. In the illustrated embodiment, certain components of the retractor assembly 33 are quite similar in structure. As such, in the drawings reference numbers for components associated with actuating the retractor assembly 33 via the inside lever 14 may include the appellation "i" and reference numbers for components associated with actuating the retractor assembly via the outside lever 16 may include the appellation "o". In this discussion, the generic reference number will usually be used when discussing structure that can apply to both inside and outside components. Although such components may be quite similar in structure, they may include some differences, which can be discussed below. Also, it is to be understood that embodiments may employ structure and operational features such as are employed in co-pending application Ser. No. 14/027,972, entitled "LOCKSET OPERABLE BY PIVOTING ACTUATOR ABOUT A FIRST AXIS OR A SECOND AXIS", the entirety of which is hereby incorporated by reference.

Figure 4:
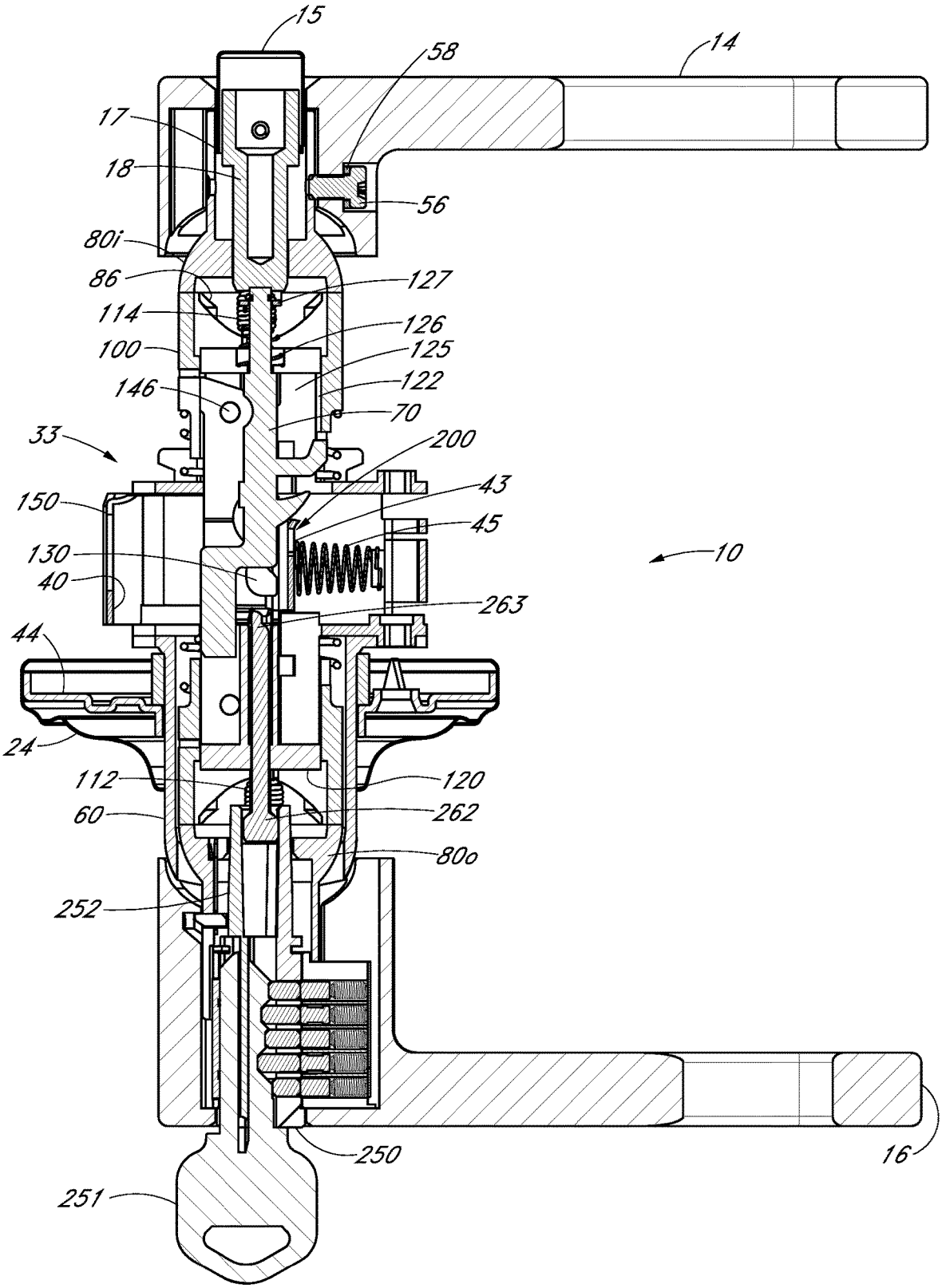
FIG. 4 shows a cross-sectional view taken along line 4-4 of FIG. 1A, shown without the inside rose, the inside mounting plate, door and the latch bolt assembly.

Continuing with reference to FIG. 3, and also FIG. 4, which shows a cross-section of the lockset 10 assembled, the retractor assembly 33 includes inside and outside elongated housings 60, each having a housing body 62 and a housing flange 66. Each housing 60 can be tubular and have a flange opening 67 and a connector opening 68. An input member 80 has a lever connector 54 that extends through the connector opening 68 and an arcuate camming surface 86. A pusher member 100 is generally cylindrical and tubular and has an arcuate camming surface 102 that is configured to engage the input member camming surface 86.

In the illustrated embodiment, a pair of springs 112 extend between and are connected to the input member 80 and the pusher member 100 so as to bias the pusher member 100 and the input member 80 into engagement with one another, and more specifically to bias the pusher member 100 and input member 80 into engagement with one another so that their respective camming surfaces 86, 102 are aligned.

A cap 120 comprises an elongate, generally-cylindrical cap body 122 and a cap flange 124. The cap flange 124 engages the housing flange 66 so that the cap body 122 extends into the housing 60 and the cap 120 and housing 60 will not rotate relative one another. With additional reference to FIG. 3, cap bolts 220 are configured to extend between and attach the housings 60, caps 120, and a casing 150. Preferably male ends of the cap bolts 220 can engage threaded bosses of the outside mounting plate 44. Also, the cap bolts 220 may have threaded female ends. Mounting bolts 48 may be extended through apertures in the inside mounting plate 46 and threaded with the female ends of the cap bolts 220 so as to secure the lockset 10 together with the door 12 sandwiched between the inside and outside mounting plates 46, 44. Inner and outer decorative rose plates 20, 24 can be fitted onto the respective mounting plates 46, 44.

With reference again to FIGS. 3 and 4, the input member 80 fits within the respective housing 60 so that the lever connector 54 extends through the connector opening 68 of the housing 60. The pusher member 100 also fits in the housing 60 adjacent the input member 80. An inner diameter of the pusher member 100 is greater than an outer diameter of the cap body 122 so that the cap body 122 is partially received within the pusher member 100. The pusher member 100 can slide over the cap body 122.

Figure 5:
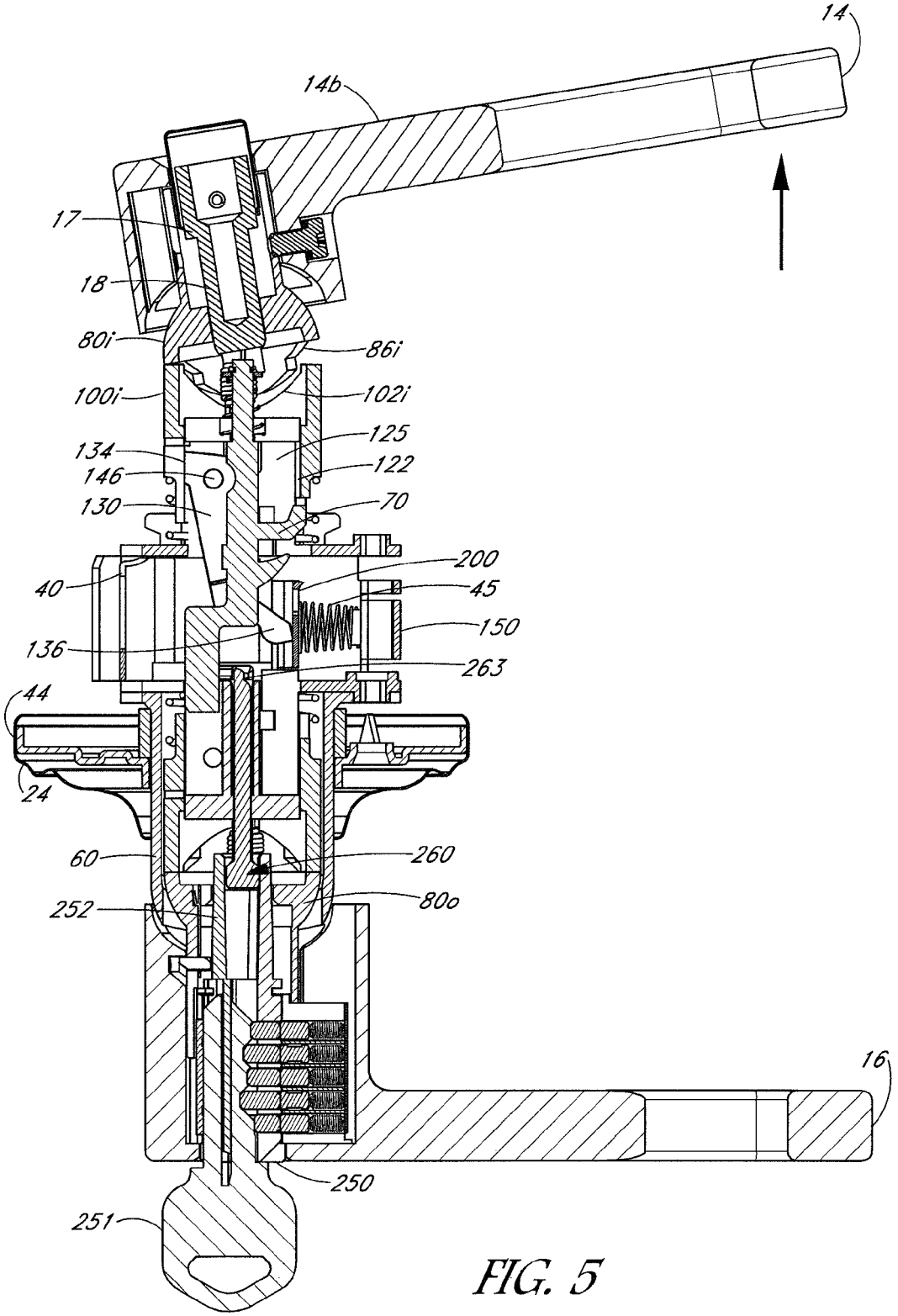
FIG. 5 shows a cross-sectional view taken along line 5-5 of FIG. 1D, shown without the inside rose, the inside mounting plate, door and the latch bolt assembly.

With additional reference next to FIG. 5, when the input member 80 rotates relative to the pusher member 100, engagement of the camming surfaces 86, 102 of the input member 80 and the pusher member 100 forces the pusher member 100 to move longitudinally away from the lever 14, 16.

In the illustrated embodiment, the lever 14, 16 is attached to the lever connector 54. With specific reference next to FIG. 5, when the lever arm 14*b* is pulled as is shown in FIG. 1D, the input member 80*i* pivots. During such pivoting a portion of the input member camming surface 86 moves longitudinally, correspondingly pushing the pusher member 100*i* longitudinally. Thus, pulling the lever arm 14*b* has the effect of moving the pusher member 100*i* longitudinally. It is to be understood that a similar interaction of the input member 80*i* and pusher member 100*i* occurs when the lever arm 14*b* is pushed.

The input member 80*i* is also rotatable within the housing 60 about the lockset axis. During such rotation, such as when the lever 14 is rotated as shown in FIG. 1C, the curving input member camming surface 86*i* engages the curving pusher member camming surface 102*i*. Such engagement of the camming surfaces 86*i*, 102*i* of the input member 80*i* and pusher member 100*i* forces the pusher member 100*i* to move longitudinally away from the lever 14.

Thus, whether the lever arm 14*b* is rotated, pushed, or pulled, the associated pusher member 100*i* will be moved longitudinally.

With continued reference to FIGS. 3-5, a retractor arm 130 preferably has an elongated, flat body 131 and extends from a lever end 134 to an actuator end 136. A locking slot 140 is disposed on the actuator end 136. An axle 144 extends through an axle hole 146 in the retractor arm body 131 and is supported by an axle receiver (not shown) in the cap body 122. As such, the retractor arm 130 is rotatably supported in a cavity 125 defined within the cap body 122. The retractor arm 130 is arranged so that the actuator end 136 is outside of the cap body cavity 125.

The lever end 134 of the retractor arm 130 is aligned with the pusher member 100 so that when the pusher member 100 is urged longitudinally, such as from the position depicted in FIG. 4 to the position depicted in FIG. 5, the pusher member 100 pushes the lever end 134 of the retractor arm 130, which causes the retractor arm 130 to rotate about the axle 144, and correspondingly causes the actuator end 136 of the retractor arm 130 to move along a curving path.

In the illustrated embodiment, a casing 150 connects on either side with the cap flanges 124. A retractor 40 (see also FIG. 7) is fit within the casing 150 and has a latch receiver slot 42 that aligns with an opening 158 in the casing 150. A pair of springs 45 are interposed between the casing 150 and a retractor engagement wall 200 to bias the retractor 40 toward the casing opening 158. In the illustrated embodiment (see FIG. 5), the retractor arm 130 extends into the retractor 40 so that the retractor arm actuator end 136 is adjacent the retractor engagement wall 200.

Continuing with reference to FIGS. 3-5, the inside and outside retractor arms 130*i*, 130*o* are positioned adjacent one another, but on opposing sides of the lockset axis. Additionally, each of the inside and outside retractor arms 130 can rotate within a plane. Such planes of rotation are adjacent one another and on opposing sides of the lockset axis.

When the inside lever 14 is rotated or pivoted, the inside retractor arm 130*i* is forced to rotate as depicted in FIG. 5. The inside retractor arm actuator end 136 thus engages the retractor engagement wall 200, pushing the retractor 40 away from the casing opening 158 and retracting the latch bolt 28. Similarly, when the outside lever 16 is rotated or pivoted, the outside retractor arm 130*o* is forced to rotate. The outside retractor arm actuator end 136 thus engages the retractor engagement wall 200, pushing the retractor 40 away from the casing opening 158 and retracting the latch bolt 28. Thus, actuating either the inside or outside lever 14, 16 has the effect of retracting the latch bolt, and operation of the components associated with one lever 14, 16 is independent of operation of the components associated with the other lever 14, 16. The retractor arm 130 can also be any other actuator mechanism that reacts to the movement of the levers 14, 16 causing the latch bolt 28 to retract.

Continuing with reference to FIGS. 3 and 4, the lock actuator button 17 fits through an axially-directed aperture in the inside lever 14 and the elongated portion 18 extends into the input member 80. The decorative button cap 15 can be secured to the proximal end of the button 17 via a fastener. In this configuration, and as demonstrated in FIGS. 4 and 5, the lock actuator button 17 pivots with the inside lever 14 and its associated input member 80*i*.

Figure 6A:
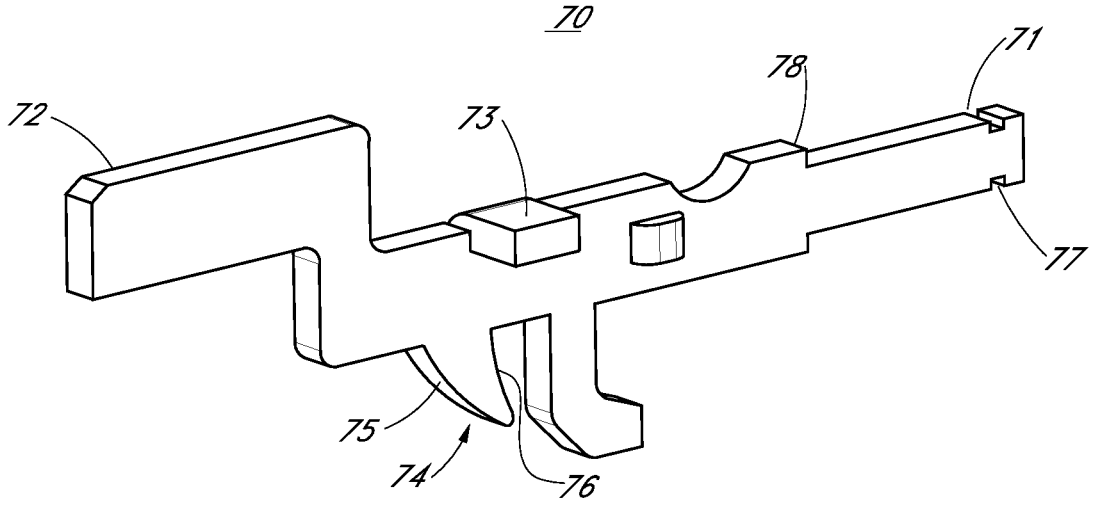
FIGS. 6A and 6B show perspective views of a lock bar actuator in accordance with an embodiment of the present disclosure.
Figure 6B:
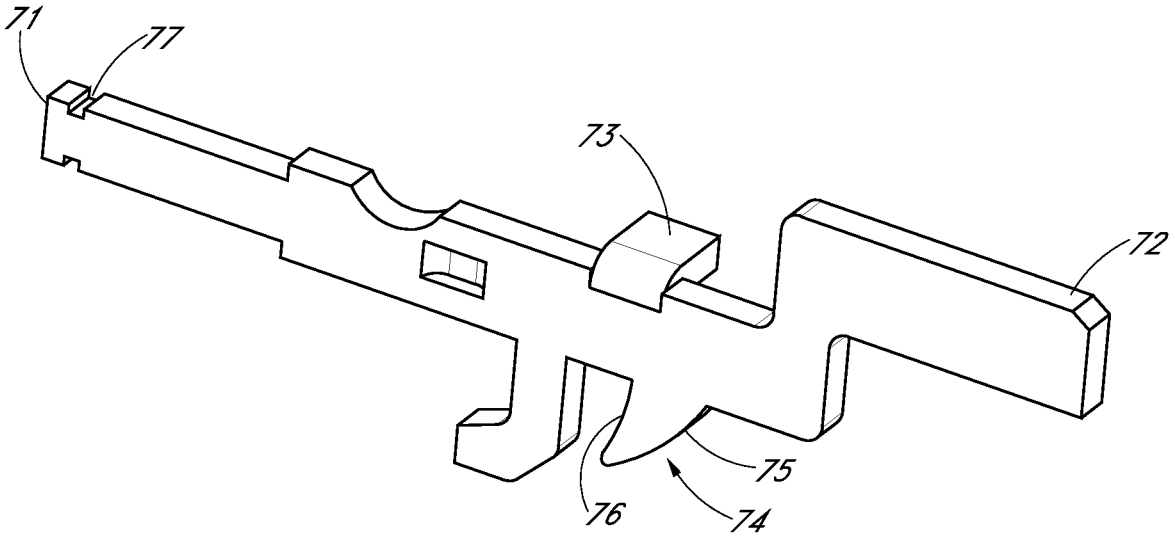

With additional reference to FIGS. 6A and 6B, an elongated lock actuator bar 70 has a proximal end 71 and a distal end 72. A locking tab 73 extends transversely from the lock actuator bar 70, and a catch member 74 extends downwardly from the lock actuator bar 70. The illustrated catch member 74 comprises an inclined and arcuate cam surface on its distal side 75. A proximal side 76 of the catch member can also have an inclined and arcuate cam surface so as to create a gentle fm-shaped hook or catch. A receiver slot 77 is formed adjacent the proximal end 71, and an offset surface 78 is spaced from the receiver slot 77.

The lock actuator bar 70 fits within the retractor assembly 33 so that its proximal end 71 is disposed adjacent the distal end of the lock button 17. In this arrangement the lock button 17 can pivot with the lever without affecting the lock actuator bar 70. Preferably a biasing spring 114 has a first end engaged with a spring seat 126 formed in a portion of the cap 120 (see FIG. 4) and a second end attached to the lock actuator bar 70 via a clip 127 that is engaged within the receiver slot 77. The offset surface 78 engages the cap 120 opposite the spring seat 126. As such, the lock actuator bar 70 is biased toward the inside lever 14 but limited in its travel via its engagement with the cap 120. The elongated lock actuator bar 70 extends generally axially within the retractor assembly 33, and preferably is disposed between the inside and outside retractor arms 130. Upper and lower guide portions of the lock actuator bar 70 help keep components within the retractor assembly 33 separated from one another.

Figure 7:
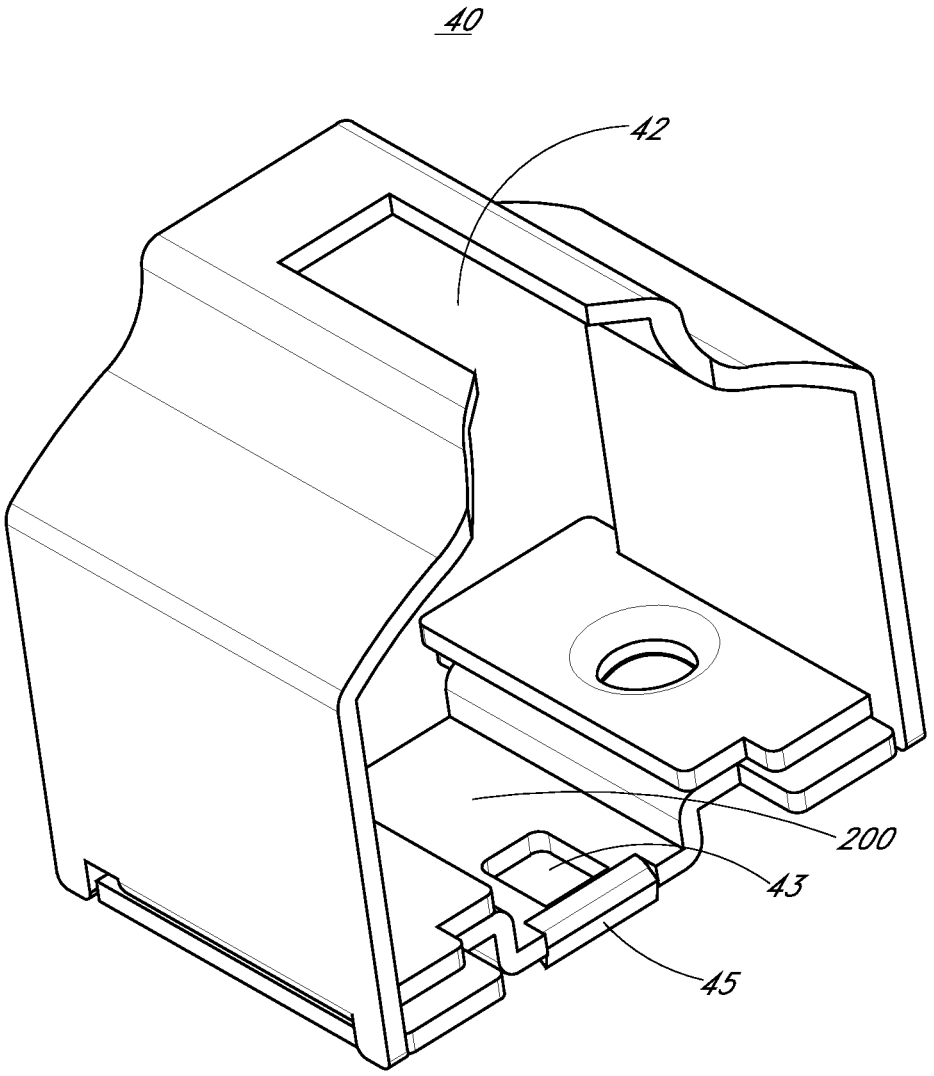
FIG. 7 is a perspective view of a retracting piece in accordance with an embodiment of the present disclosure.

With reference next to FIG. 7, a perspective view of the retractor 40 is shown. As shown, the retractor engagement wall 200 is disposed generally opposite the latch receiver slot 42. In the illustrated embodiment, a retaining slot 43 is formed through the engagement wall 200. Preferably the retaining slot 43 is sized to receive the catch member 74 of the lock actuator bar 70 therewithin. An inclined lock bar strike plate 45 adjacent the retaining slot 43 is configured to interact with the distal camming surface 75 of the catch member 74 so that the camming surface 75 will urge the retractor 40 to move downwardly when the lock actuator bar 70 moves transversely through the retractor 40.

Figure 8:
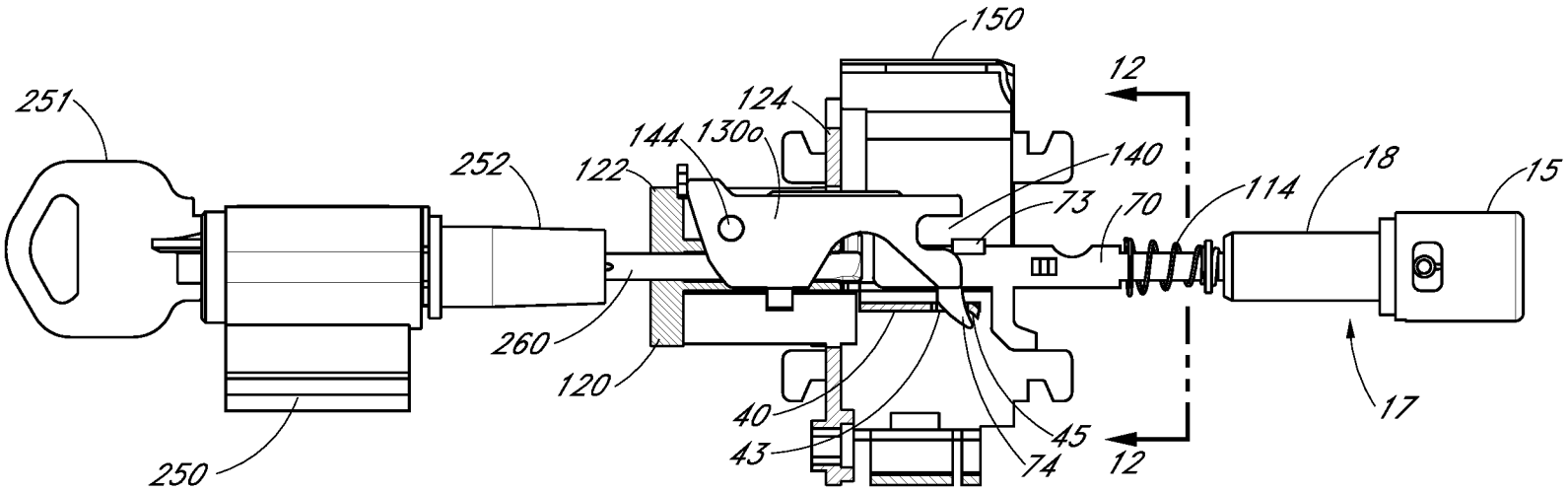
FIG. 8 shows a side view of selected components of a lockset according to one embodiment in a locked position.

In FIGS. 4 and 5, the lock actuator bar 70 is shown in an unlocked position. However, when the lock button 17 is depressed, the lock button 17 urges the lock actuator bar 70 further into the retractor assembly 33 so that the distal cam surface 75 of the catch member 74 engages the lock bar strike plate 45 of the retractor engagement wall 200, thus urging the retractor 40 downwardly until the tip of the catch member 74 clears the strike plate 45. Eventually the catch member 74 will reach the retaining slot 43, and the spring-biased retractor 40 will be pushed back upwardly, capturing the catch member 74 within the retainer slot 43 as depicted in FIG. 8. Although the biasing spring 114 biases the lock actuator bar 70 toward the inside lever 14, because the catch member 74 is captured in the retaining slot 43, the lock actuator bar 70 is retained in an advanced, locked position.

With continued reference to FIG. 8, the outside retractor arm 130*o* is shown. Although all of the actuation components are not shown in this view, actuation of the outside retractor arm 130*o* operates in a manner similar to actuation of the inside retractor arm 130*i* as discussed above. More specifically, upon actuation of the outside lever 16, the retractor arm 130*o* is rotated about the axle 144 so that its actuator end 136 engages the retractor engagement wall 200 and follows an arcuate curve that pushes the retractor 40 downwardly. When the lock actuator bar 70 is in the locked position as shown in FIG. 8, the locking tab 73 of the lock actuator bar 70 extends at least partially into the locking slot 140 of the retractor arm 130. In this position, the retractor arm 130 is prevented from rotating sufficiently to move the retractor 40 to retract the latch bolt 28 or release the lock bar catch member 74 from the retaining slot 43. As such, the retractor assembly 33 is locked.

With reference again to FIG. 3, a keyed lock cylinder 250 is axially arranged within the outside lever 16 and is configured to accept a key 251. The lock cylinder 250 includes an elongated receiver 252 that is configured to receive a receiver end 262 of an elongated unlock bar 260 (see also FIGS. 4 and 5). As depicted in FIGS. 4, 5 and 8, the unlock bar 260 extends from the lock cylinder 250 through the cap body 122 and cap flange 124. The unlock bar 260 can be configured to perform a locking or unlocking function when actuated.

Figure 9A:
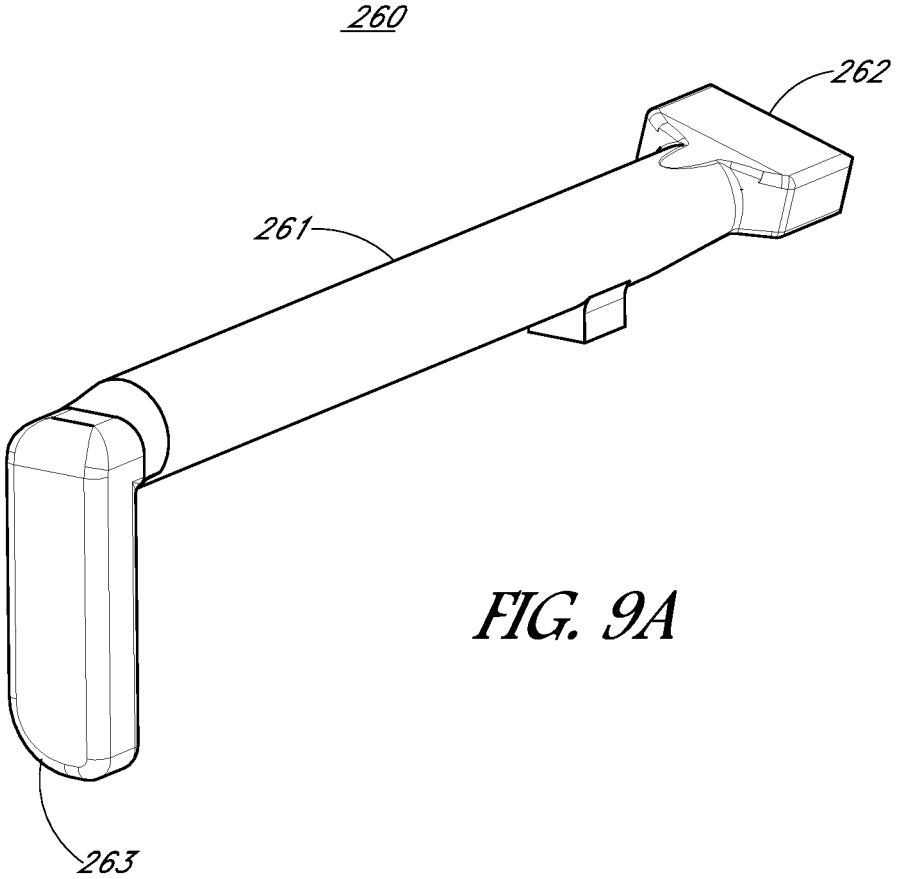
FIGS. 9A and 9B show perspective views of an unlock bar in accordance with an embodiment of the present disclosure.
Figure 9B:
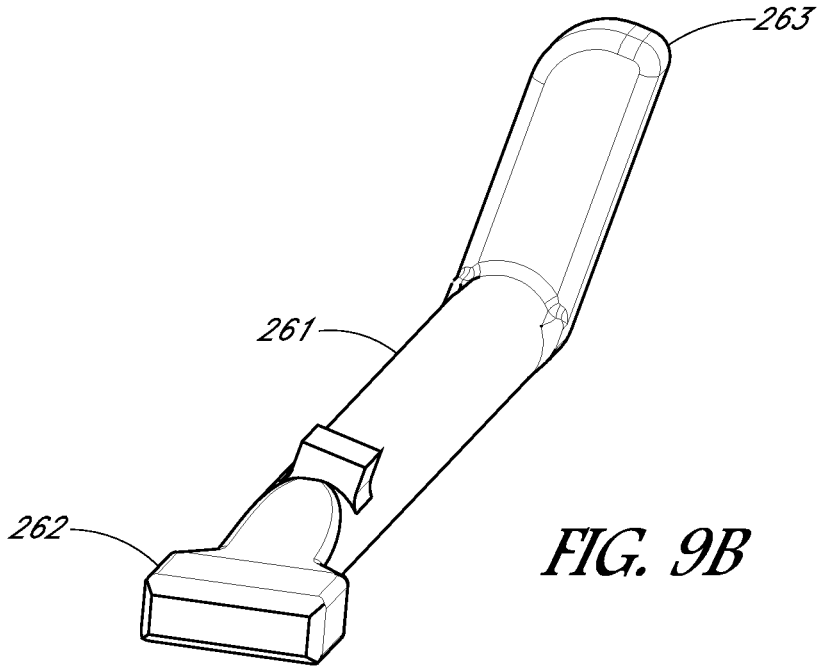
Figure 10:
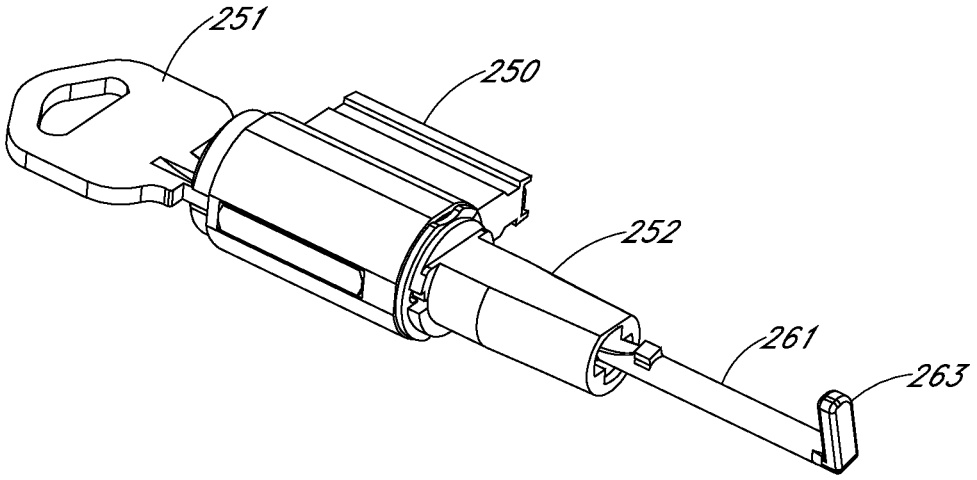
FIG. 10 is a perspective view of a keyed cylinder engaged with the corresponding unlock bar.
Figure 11:
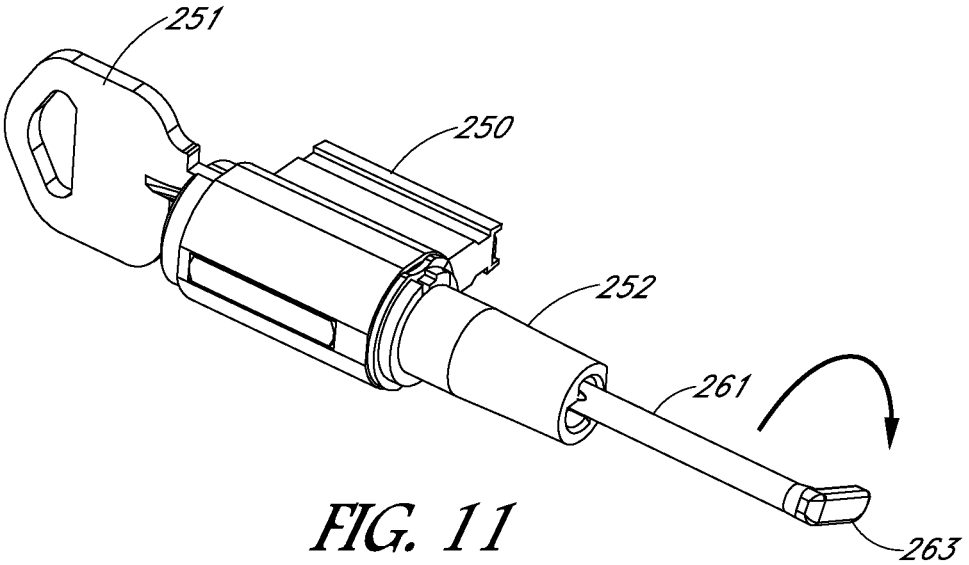
FIG. 11 shows the arrangement of FIG. 10 when the key is rotated.

With reference next to FIGS. 9A and 9B, the unlock bar 260 has a receiver end 262 and an actuator end 263. A body 261 of the unlock bar 260 is generally cylindrical, but the receiver end 262 is flared outwardly and preferably at least partially flattened so as to have a greater width and to define flat engagement surfaces. With reference next to FIGS. 10 and 11, the receiver end 262 of the unlock bar 260 is fit into the elongated receiver 252 of the lock cylinder 250. Actuation of the key 251 rotates the elongated receiver 252. Guides (not shown) in the elongated receiver 252 contact the engagement surfaces of the receiver end 262 so that the unlock bar 260 rotates with the elongated receiver 252.

Figure 12:
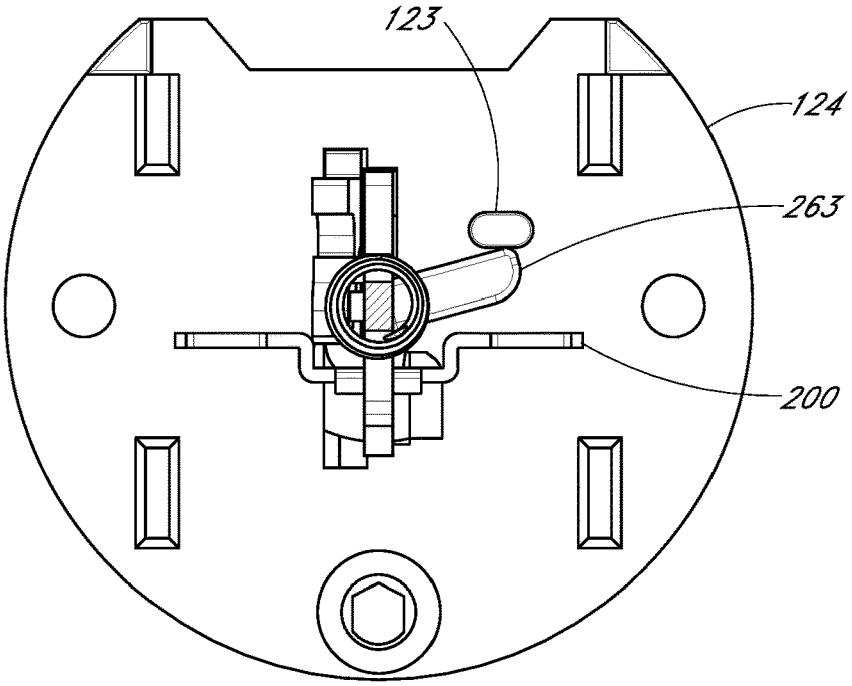
Figure 13:
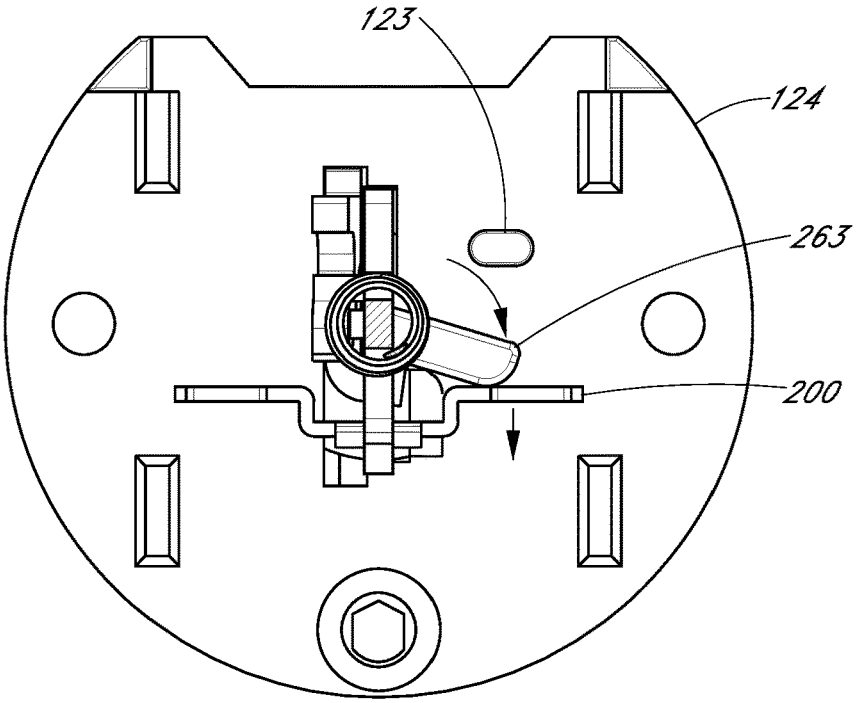
FIG. 13 shows the arrangement of FIG. 12 with the unlock bar being actuated.

As shown, the actuator end 263 of the unlock bar 260 extends radially outwardly from the unlock bar 260. With reference next to FIG. 12, which shows an end view of the locked configuration shown in FIG. 8, the actuator end 263 sits adjacent the cap flange 124. A protrusion 123 extending from the cap flange 124 preferably blocks the actuator end 263 from rotating in an undesired direction in which the actuator end 263 may interfere with other components. When the key 251 is actuated to rotate the unlock bar 260 towards an unlocking position as depicted in FIGS. 10 and 11, the actuator end 263 rotates from the position depicted in FIG. 12 to the position depicted in FIG. 13. In this operation, the actuator end 263 engages the retractor engagement wall 200 and pushes it downwardly a sufficient distance so that the catch member 74 of the lock actuator bar 70 is released from the retaining slot 43. Once the lock actuator bar 70 is released, its biasing spring 114 will pull it toward the inside lever 14, and the locking tab 73 will be removed from the locking slot 140 of the outside retractor arm 130. The lockset 10 will thus be unlocked.

Figure 14:
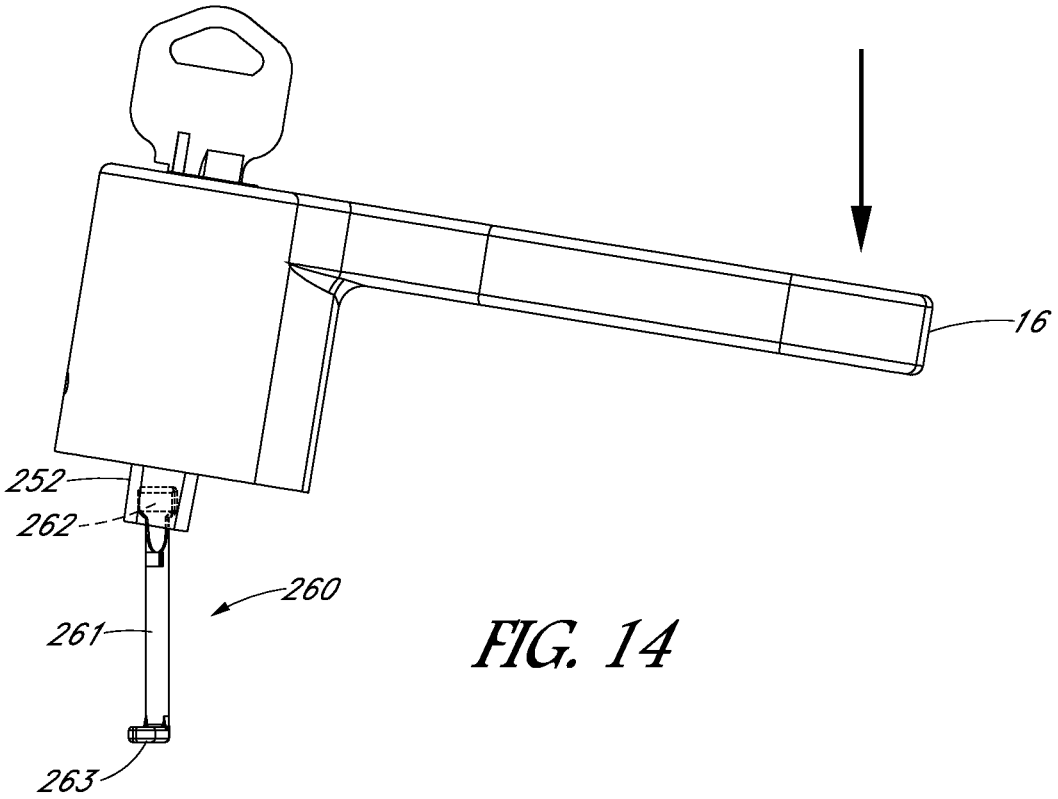
FIG. 14 is a perspective view showing the interaction of the lever, keyed lock cylinder and unlock bar during pivoting of the lever.
Figure 15:
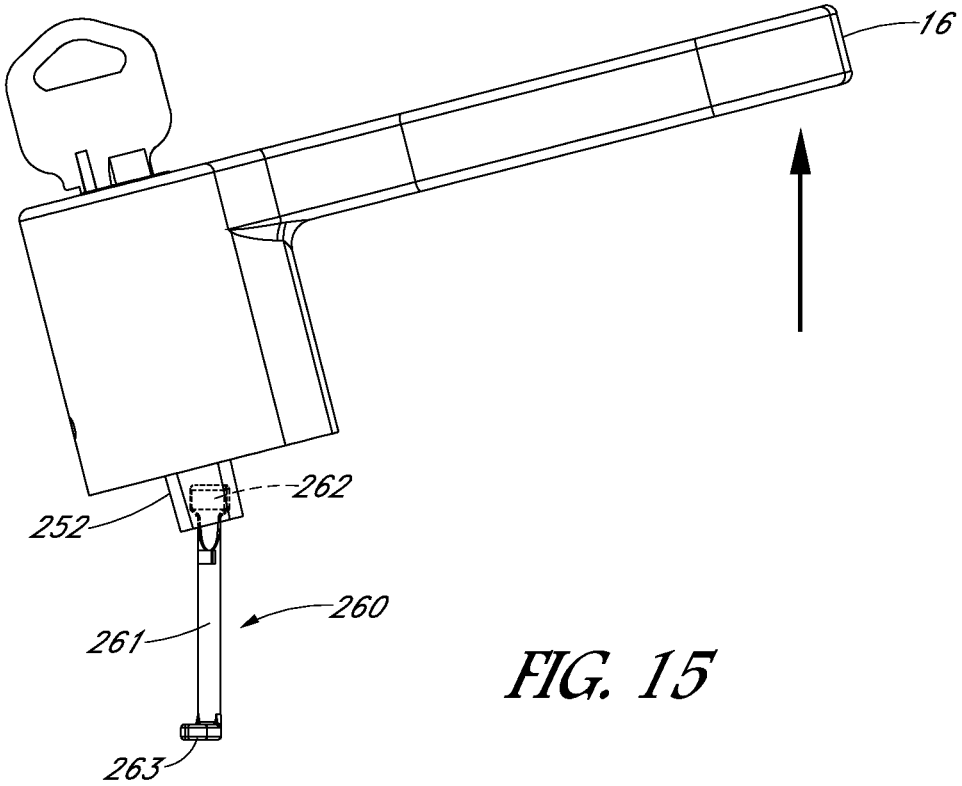
FIG. 15 shows the arrangement of FIG. 14 with the lever pivoted in a different direction.

With reference next to FIGS. 14 and 15, the keyed lock cylinder 250 is attached within the outside lever 16 so that when the lever 16 pivots when actuated by pushing and pulling, the lock cylinder 250 pivots with the outside lever 16. The receiver end 262 of the unlock bar 260 is configured to fit within the elongated receiver 252 of the keyed lock cylinder 250 so that the receiver end 262 is retained within the elongated receiver 252 when the lock cylinder 250 pivots with the outside lever 16, but such pivoting does not affect the position of the unlock bar 260. Since the receiver end 262 is flared relative to the elongated body 261 of the unlock bar 260, the flared receiver end 262 defines engagement surfaces for the guides of the lock cylinder elongated receiver 252 to engage to rotate the unlock bar 260. As shown, the flared receiver end 262 is fit into the elongated receiver 252 and spaced from the opening sufficiently so that when the lock cylinder 250 pivots with the outside lever 16, the opening approaches a neck portion adjacent the flared end 262. The neck portion is thinner than the flared end 262. As such, the unlock bar 260 does not interfere with pivoting, and the opening of the elongated receiver 252 does not bind or deflect the unlock bar 260 during pivoting.

In the illustrated embodiment, the keyed lock cylinder 250 is configured to rotate the unlock bar 260 so as to perform the locking-related function of moving the lockset 10 from a locked configuration to an unlocked configuration. In other embodiments, the keyed lock cylinder 250 can be attached to an elongated locking actuator to perform other locking-related functions, such as locking and unlocking the lockset 10. In such embodiments the elongated locking actuator may have a distal portion arranged quite differently than as provided herein, however the proximal portion may employ similar principles. For example, the proximal portion of the elongated locking actuator may be received in the elongated guide of the lock cylinder 250, and the lock cylinder 250 may pivot with the handle while the proximal portion remains within the elongated guide. And in some embodiments the elongated locking actuator may intersect a point about which the keyed lock cylinder 250 pivots, even though the locking actuator itself does not pivot.

Figure 16A:
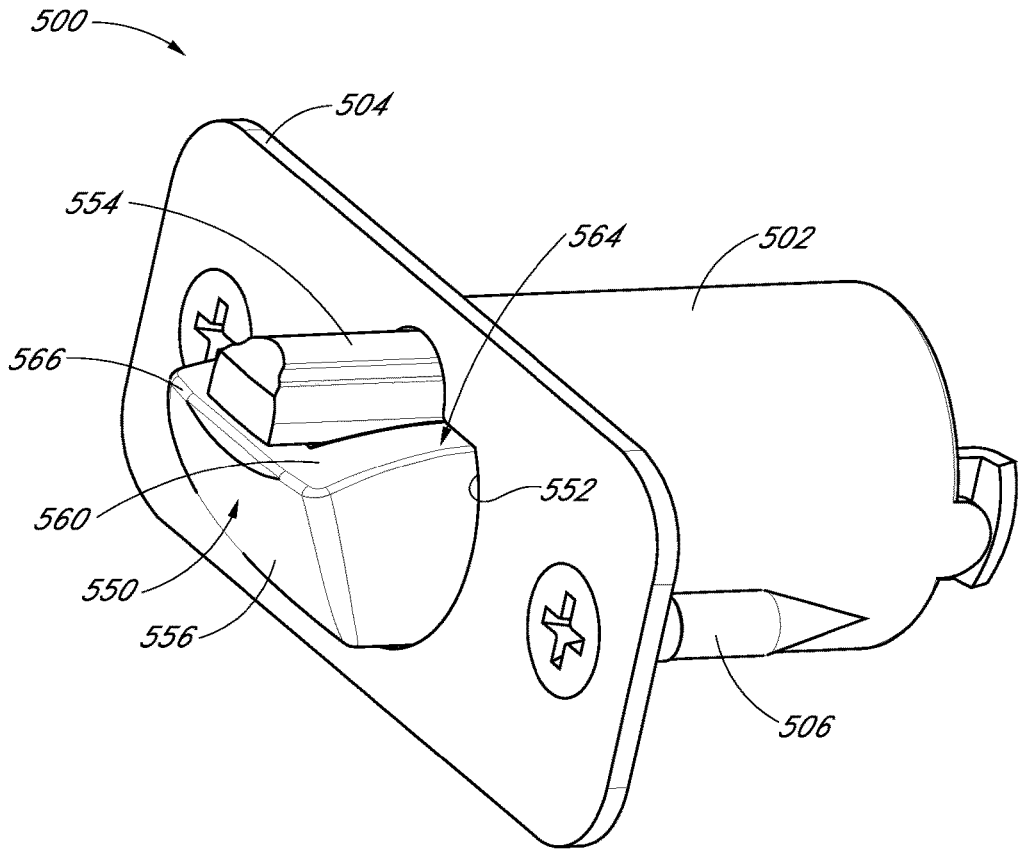
FIG. 16A is a perspective view of another embodiment of a latch assembly.
Figure 16B:
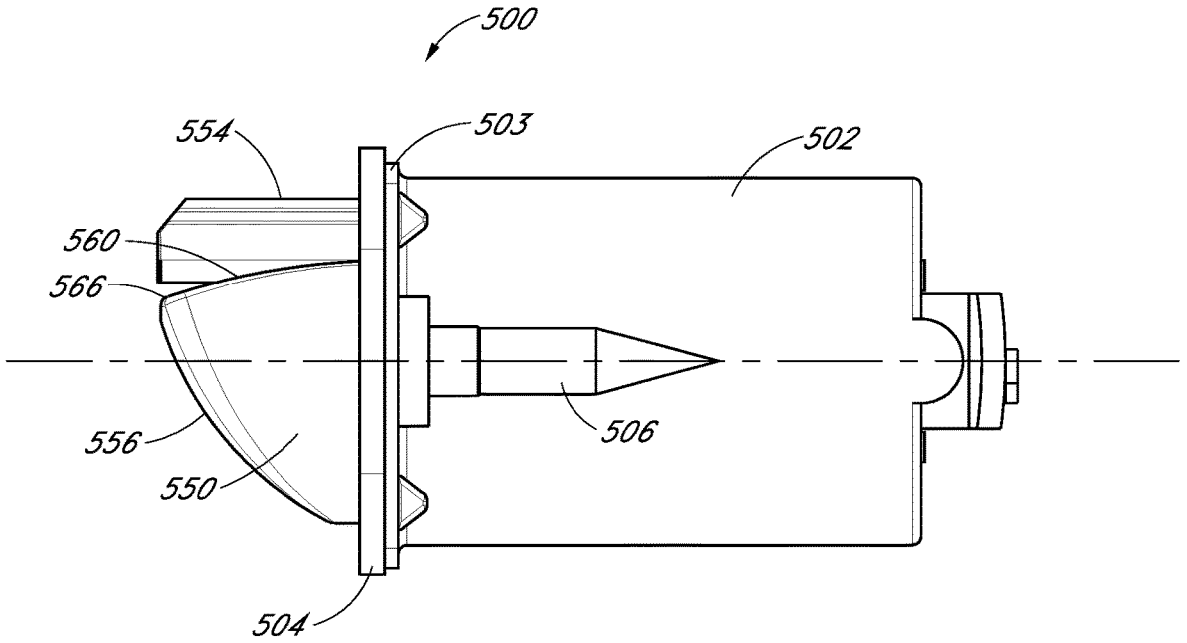
FIG. 16B is a side view of the latch assembly of FIG. 16A.

The embodiments discussed above have been depicted as using a simple and typical latch bolt assembly 36. It is to be understood that any acceptable one of a range of latch bolt assemblies can be used. With reference next to FIGS. 16A and 16B, another embodiment of a latch bolt assembly 500 is shown, which can also be used in connection with embodiments having features as discussed herein.

The illustrated latch bolt assembly 500 includes a cylindrical housing 502 and a faceplate 504 that can be secured to the door via screws 506. A latch bolt 550 extends through an aperture 552 in the faceplate 504 and is configured so that it can be selectively retracted into the housing 502 as with typical latch bolts. A dead latch trigger 554 also extends through the aperture 552 in the faceplate 504 and can also be selectively retracted into the housing 502. The portions of the latch bolt 550 visible in FIGS. 16A and 16B include an inclined cam surface 556 that is configured to engage a strike plate of the door such as when the door is being closed so as to push the latch bolt 550 into the housing 502 in a typical manner. A blocking surface 560 of the latch bolt 550, however, is generally inclined. More specifically, in the illustrated embodiment, the blocking surface 560 is generally arcuate and inclined relative to an axis of the latch bolt assembly 500. More specifically, a base portion 564 of the blocking surface 560 generally adjacent the faceplate 504 has a minimal or zero slope relative to the axis. However, the slope of the blocking surface in the illustrated embodiment continuously increases moving towards a tip 566 of the latch bolt 550 at which the cam surface 556 and blocking surfaces 560 meet.

Figure 17:
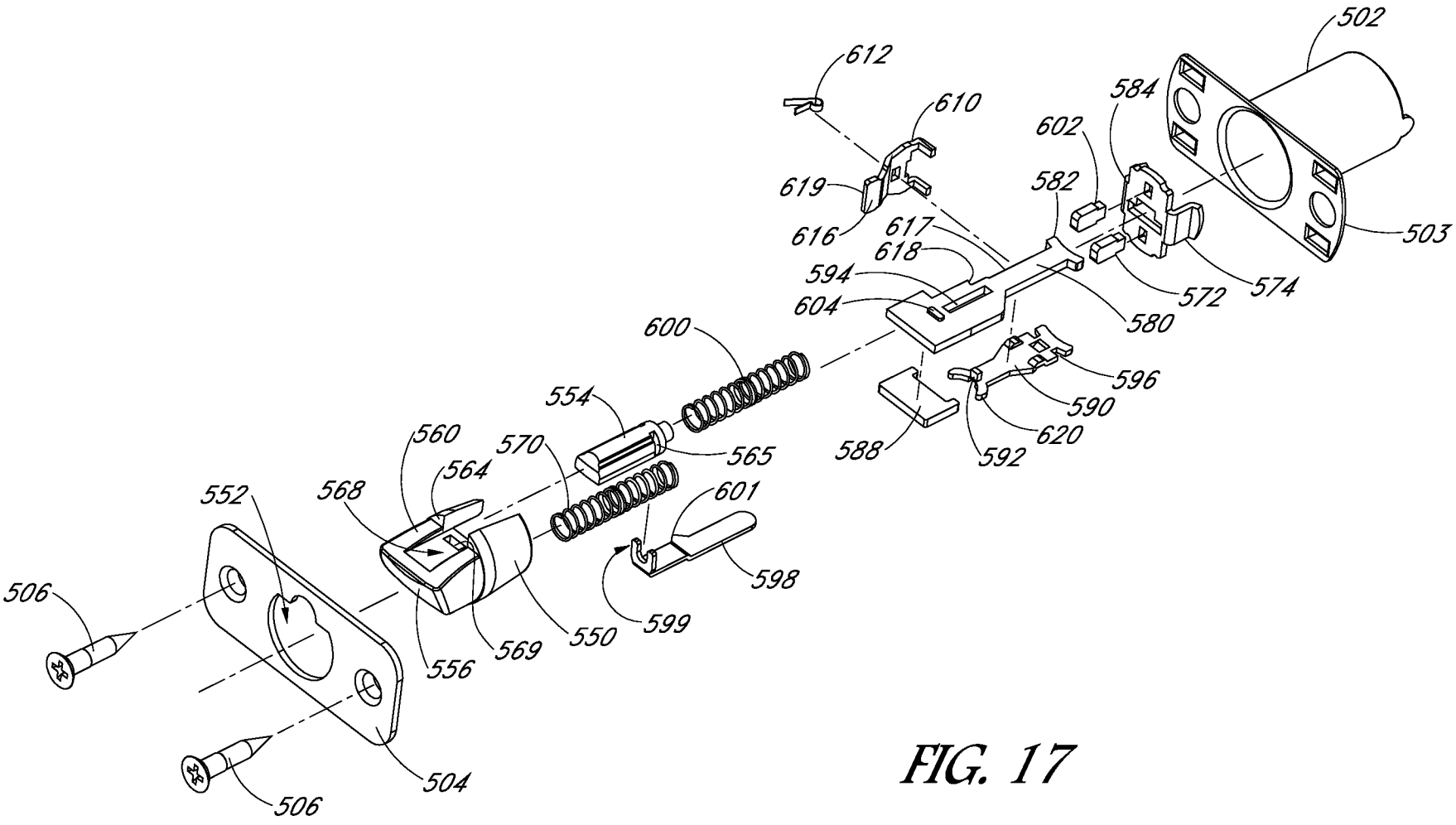
FIG. 17 is an exploded view of the latch assembly of FIG. 16A.
Figure 18C:
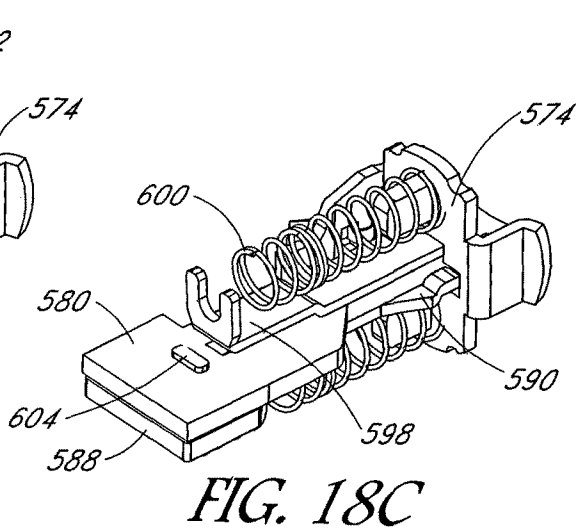
FIGS. 18A-18F are perspective views of the latch assembly of FIG. 16A taken from various perspectives and with some components removed so as to illustrate an assembly of certain components.
Figure 18B:
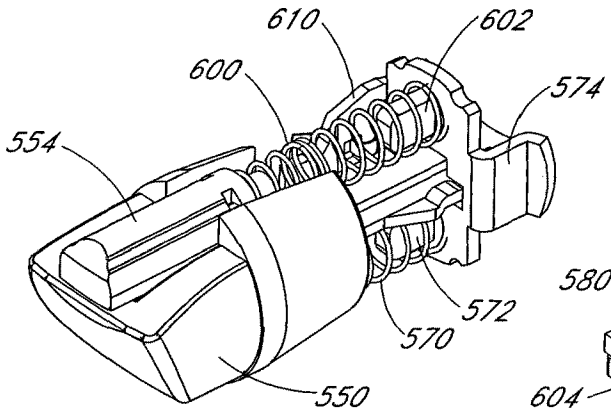
Figure 18A:
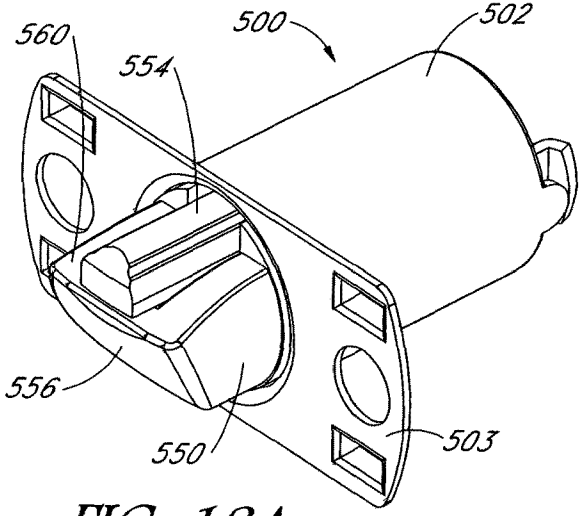
Figure 18F:
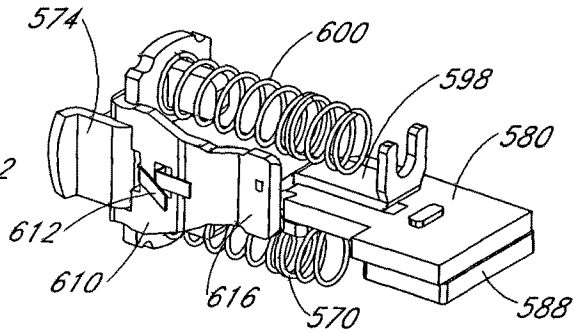
Figure 18E:
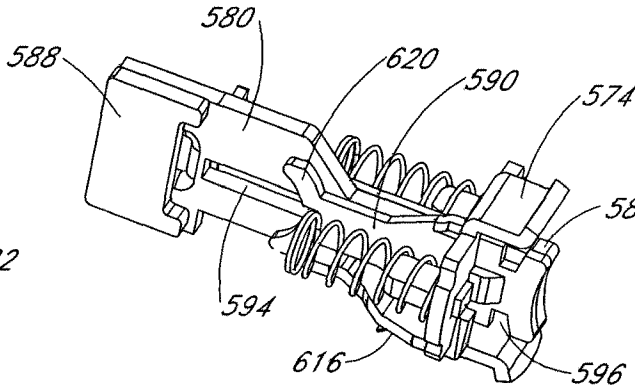
Figure 18D:
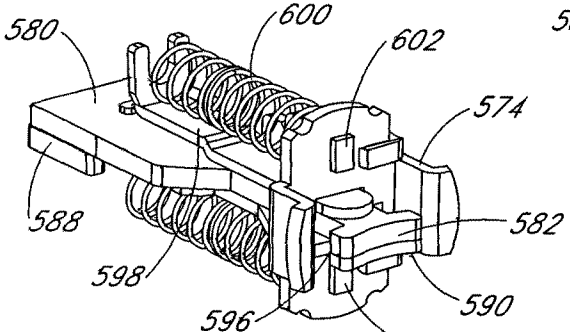

With reference next to FIGS. 17 and 18, the illustrated latch bolt assembly 500 includes the faceplate 504 having the faceplate aperture 552. The latch bolt assembly 500 is attachable to a door via the screws 506. The latch bolt 550 extends through the faceplate aperture 552, as does the dead latch trigger 554. The dead latch trigger 554 is slidable within a trigger guide 568 defined within the latch bolt 550. A bolt spring 570 is interposed between the latch bolt 550 and a spring boss 572 that mounts permanently on a base 574 so that the latch bolt 550 is biased to extend through the faceplate aperture. A primary latch rod 580 has one end that attaches to the latch bolt 550 and another end having a flared connector 582. The flared connector 582 extends through a rod aperture 584 in the base 574 and is configured to connect to a retractor latch engagement portion 90 of a lockset. A block 588 is received in a mating cavity (not shown) and is permanently affixed to the latch bolt 550 to fix the primary latch rod 580 to the latch bolt 550. A first latch rod 590 also sits adjacent the primary latch rod 580 and is slidable relative to the primary latch rod 580. A tab 592 of the first latch rod 590 fits slidably within a slot 594 of the primary latch rod 580. The first latch rod 590 also includes a connector slot 596 and is configured to fit through the rod aperture 584 and connect to the retractor assembly 33. However, the latch engagement portion of the retractor assembly 33 fits within this connector slot 596, so that the first latch rod 590 does not translate unless the retractor 40 also translates.

A trigger carrier 598 has a flared U-shaped connector end 599 that engages the receiving groove 565 in the dead latch trigger 554 and a cam surface 601 at a side of the trigger carrier 598. A trigger spring 600 extends between the dead latch trigger 554 and a spring boss 602 that is permanently affixed to the base 574 so that the dead latch trigger 554 is biased to extend through the faceplate 504 with the latch bolt 550. A tab 604 on the primary latch rod 580 is configured to engage a latch bolt aperture of the latch bolt 550, so that when the primary latch rod 580 is pulled inwardly by the retractor 40, the dead latch trigger 554 is withdrawn with the latch bolt 550. A dead latch 610 is positioned to the side of the base 574 and a biasing spring 612 engages the inside wall of the housing 502 to bias the dead latch 610 toward the primary latch rod 580. The dead latch 610 has a stop surface 619. The cam surface 601 of the trigger carrier 598 is configured for pressing against a stop surface side portion 616 in opposition to the biasing spring 612. When the dead latch trigger 554 is in the fully-extended position shown in FIGS. 18A and 18B, the cam surface 601 engages the stop surface side portion 616 so that it is spaced from the primary latch rod 580.

When the latch bolt assembly 500 is in an at-rest, closed position, such as when a door to which the latch bolt assembly 500 is mounted is closed, the dead latch trigger 554 is typically pushed into the housing 502 by a door strike plate. When the dead latch trigger 554 is pushed into the housing 502, the trigger carrier 598 is also pushed with the dead latch trigger 554 thereby moving the cam surface 601 out of engagement with the stop surface side portion 616 of the dead latch 610. The biasing spring 612 thus urges the stop surface side portion 616 into engagement with an edge surface 617 of the primary latch rod 580 so that the stop surface 619 is positioned to engage an offset surface 618 of the primary latch rod 580 to prevent the primary latch rod 580, and thus the latch bolt 550, from being drawn into the housing 502. Thus, the latch bolt 550 is blocked from being drawn into the housing 502 when the dead latch 610 is engaged.

The first latch rod 590 includes a dead latch cam 620. When the latch bolt assembly 500 is actuated, and the first latch rod 590 is pulled inwardly by the retractor 40, the dead latch cam 620 engages the dead latch 610 at the stop surface side portion 616 to push the stop surface 616 out of engagement with the offset surface 618, and thus freeing the primary latch rod 580 and associated latch bolt 550 to be retracted into the housing 502. Once the dead latch 610 is disengaged, the latch bolt 550 is free to be drawn into the housing 502.

In one embodiment, the latch bolt assembly 500 can be configured so that there is a delay between the moment the latch bolt assembly 500 begins to be actuated (such as when a user begins to actuate the retractor of an associated lockset) and when the dead latch cam 620 pushes the stop surface 616 out of engagement (or alignment) with the offset surface 618 so as to release the dead latch 610. In one embodiment, a distance between the connector slot 596 and the dead latch cam 620 of the first latch rod 590 is selected so that the dead latch cam 620 is spaced a delay distance from the dead latch stop surface side portion 616 when the latch bolt assembly is at rest. As such, the retractor 40 must pull the first latch rod 590 the delay distance before the dead latch cam 620 engages the dead latch 610. As such, relatively small movement of the retractor 40 will not release the dead latch 610.

Other embodiments may employ other structures to create a delay between initial actuation of the retractor 40 and release of the dead latch 610. For example, the shape of the dead latch cam 620 can be altered to delay engagement with the dead latch stop surface side portion 616. In another embodiment, the stop surface side portion 616 can be shortened to delay engagement between the dead latch cam 620 with the dead latch 610. Multiple configurations including combinations already discussed can be employed to create a delay in releasing the dead latch 610 from engagement with the edge surface 617 and the offset surface 618.

In a preferred embodiment, the dead latch assembly 500 is configured so that the delay between the moment when the retractor 40 begins to be actuated and when the dead latch 610 is disengaged generally corresponds at least to the extent that the lockset retractor 40 can be moved when the lockset is in a locked position. For example, with reference again to FIG. 8, which shows an embodiment of lockset components in a locked configuration, since the locking tab 73 is disposed partially in the locking slot 140 of the retractor arm 130*o*, the retractor arm 130*o* is blocked from rotating past the locking tab 73. However, because there is some space between the locking tab 73 and walls of the slot 140, if the outside handle were actuated when in the locked position, the retractor arm 130*o* would rotate a short distance until a wall of the slot 140 engaged and was blocked by the locking tab 73. Thus, the retractor 40 would be pushed a relatively short lock space distance before the locking mechanism blocked further actuation. In a preferred embodiment, the latch bolt assembly 500 is configured so that a delay distance, which can be defined as a distance that the first latch 290 is withdrawn before the dead latch 610 is released, corresponds to the lock space distance. In another embodiment, the delay distance is configured to be greater than the lock space distance.

Figure 19A:
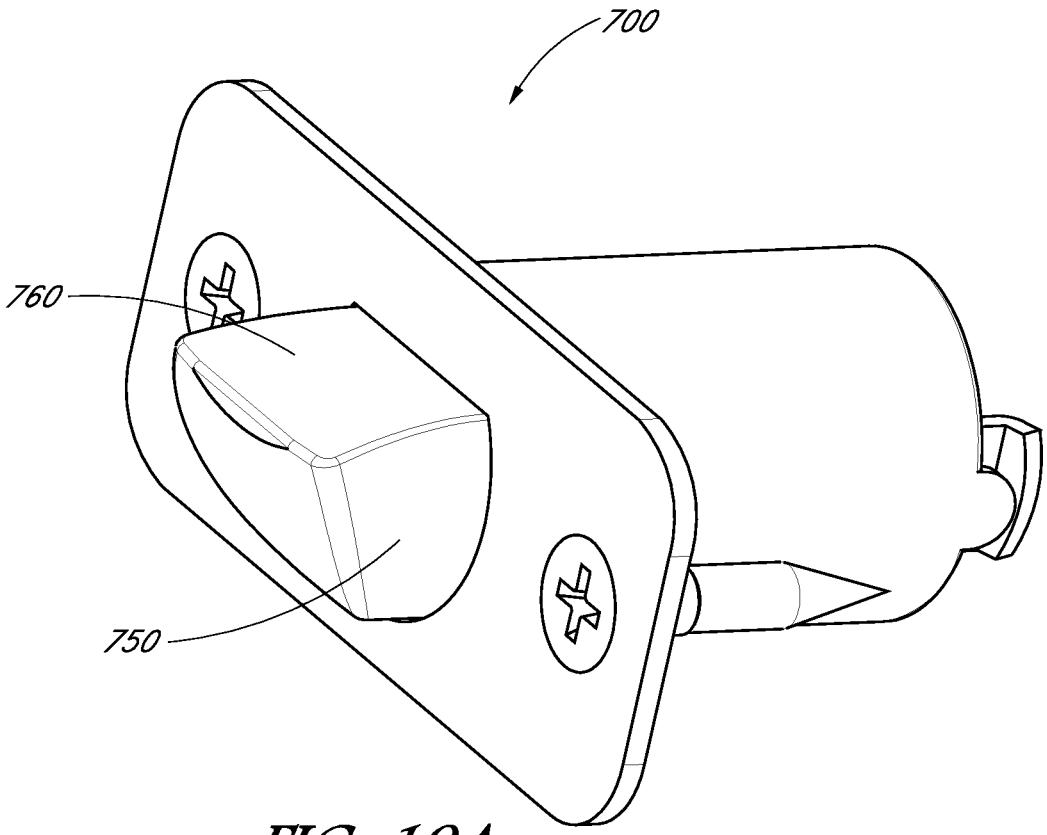
FIG. 19A is a perspective view of yet another embodiment of the latch assembly.
Figure 19B:
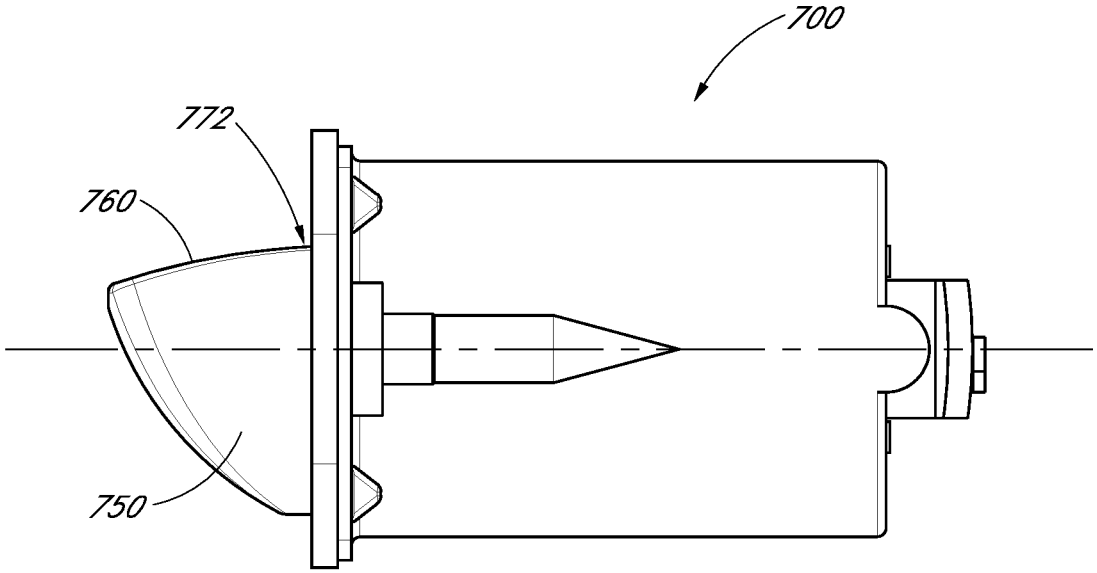
FIG. 19B is a side view of the latch assembly of FIG. 19A.
Figure 20A:
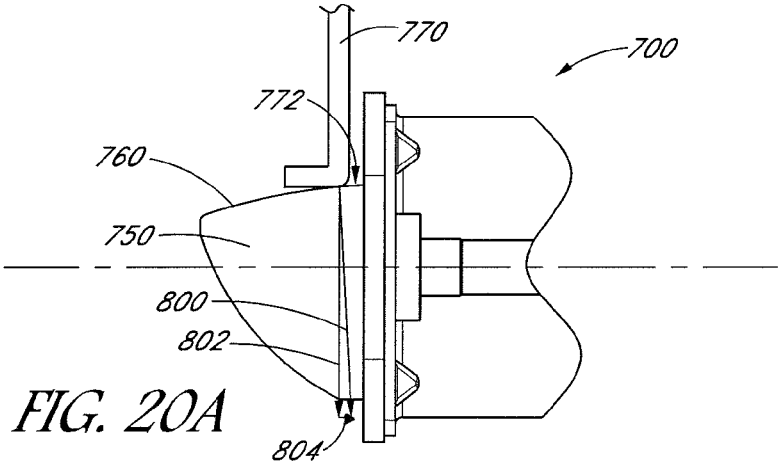
FIGS. 20A-20C are side views of the latch assembly of FIG. 19A showing the latch bolt interacting with a portion of a corresponding door's strike plate at three spaced apart stages during retraction of the latch bolt while opening the door.
Figure 20B:
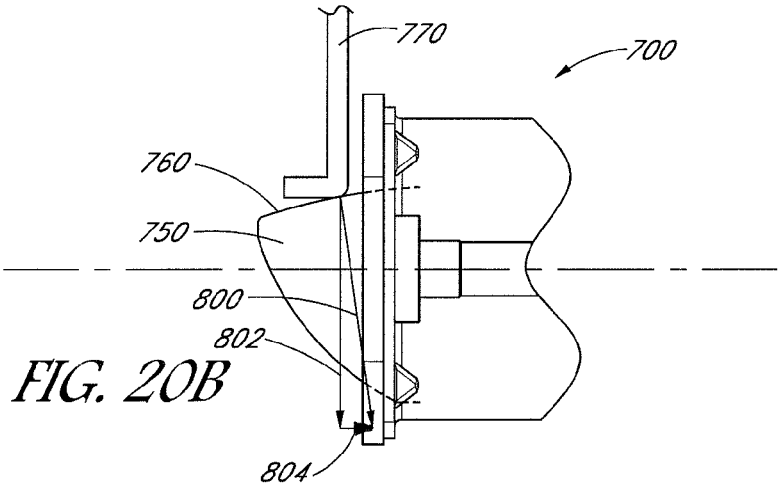
Figure 20C:
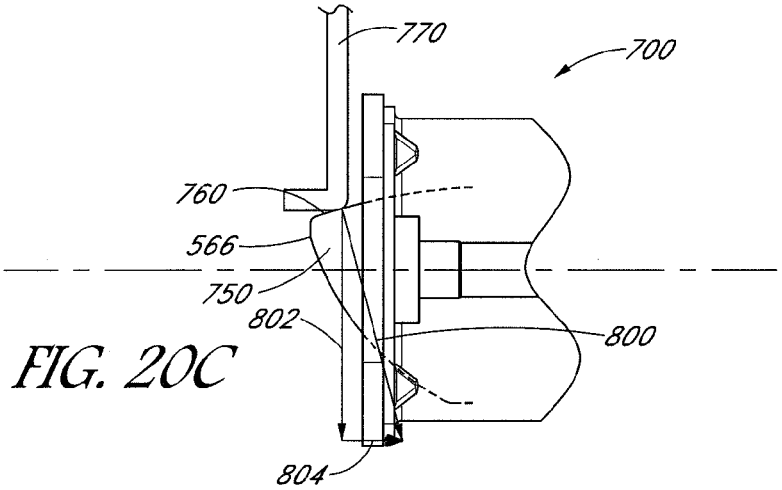

FIGS. 19A and 19B show another embodiment of a latch assembly 700 in which the blocking surface 760 of the latch bolt 750 is arcuate, but the latch bolt assembly 700 does not include a dead latch trigger. FIGS. 20A-20C illustrate operation of the latch assembly 700 of FIG. 19B at three different stages during the process of actuating the latch bolt 750 and opening the door. In these figures, the latch assembly 700 will be discussed as though it is being used in connection with embodiments described above, and specifically being used by a user who is pushing upon the handle of a handle set embodiment having features similar to those of FIG. 1. During such an operation, since the user is pushing on the handle, it is also anticipated that at least a portion of the user's pushing force will push the blocking surface 760 of the latch bolt 750 against an edge of the corresponding door's strike plate 770.

Of course, during this process, the latch bolt 750 is retracted into the housing so as to disengage the blocking surface 760 from the strike plate 770 and allow the door to be opened. However, early in the operation, as shown in FIG. 20A, a base portion 772 of the blocking surface 760 having only a minimal slope relative to the axis of the blocking surface 760 engages the strike plate 770. A force 800 applied by the strike plate 770 in a direction perpendicular to the blocking surface 760 at the point of contact has, as shown in FIG. 20A, a relatively large normally-directed force component 802 and a very small axially-directed force component 804. However, with reference next to FIG. 20B, as the latch bolt 750 is withdrawn, the strike plate 770 contacts the blocking surface 760 at a contact point having increased slope. Thus, as shown, the axially-directed force component 804 is increased relative to the arrangement illustrated FIG. 20A. Further, with specific reference to FIG. 20C, as the latch bolt 750 is withdrawn further so that the strike plate 770 nears the tip 566, the slope of the blocking surface 760 has increased yet further, and the axially-directed force component 804 has also increased further. Due to the increasing axially-directed force component 804, resistance of the latch bolt 750 to withdrawal due to friction between the blocking surface 760 and the edge of the strike plate 770 is reduced as the latch bolt is withdrawn.

In the illustrated embodiment, the blocking surface 760 has a small incline at the contact point near its base 772 where it first meets the edge of the door's strike plate 770 before or upon initiation of withdrawal of the latch. As such, the axially-directed force component 804 remains small and substantial frictional resistance remains to resist withdrawal of the latch bolt 750. This can be intentional, as it is undesirable for the latch bolt to be unintentionally actuated by, for example, a possible intruder, wind or the like simply pressing against the door. Thus, in the illustrated embodiment, the blocking surface 760 has a zero or only minimal slope relative to the latch assembly axis near the base 772 of the blocking surface 760 where the blocking surface 760 may engage the strike plate 770 while the door is closed.

Figure 21:
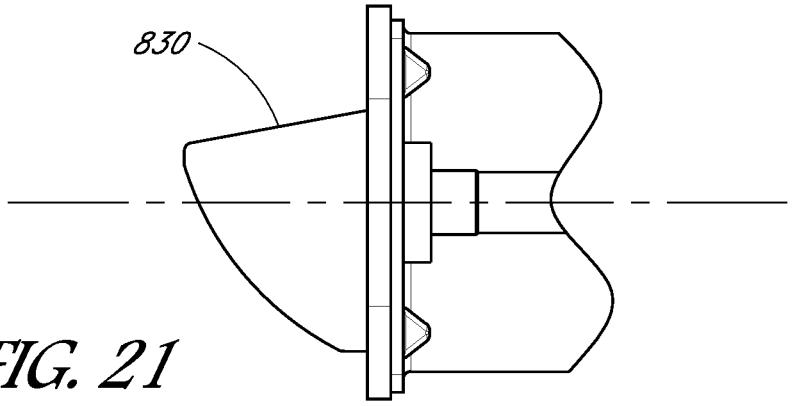
FIG. 21 is a side view of a latch assembly having a latch bolt configured in accordance with another embodiment.
Figure 22:
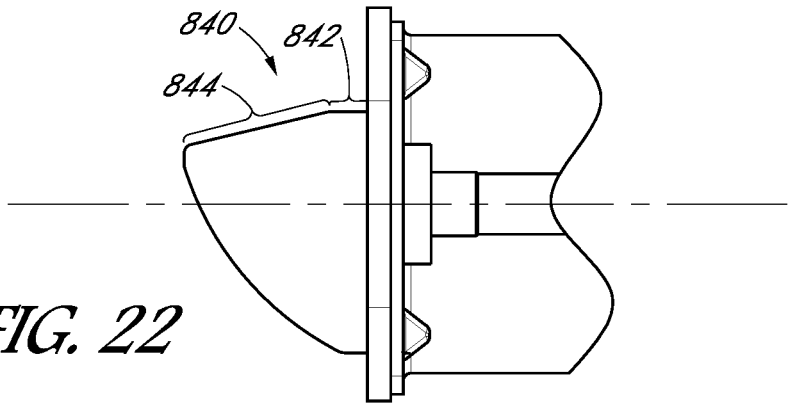
FIG. 22 is a side view of a latch assembly having a latch bolt configured in accordance with still another embodiment.
Figure 23:
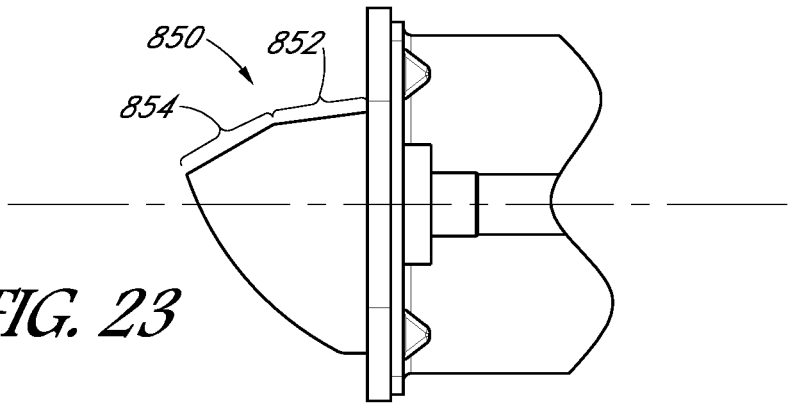
FIG. 23 is a side view of the latch assembly having a latch bolt configured in accordance with yet another embodiment.

With reference next to FIG. 21, in another embodiment, the blocking surface 830 of the latch bolt is a substantially flat and has a constant slope relative to the axis. In the embodiment illustrated in FIG. 22, the latch bolt blocking surface 840 has multiple slope zones. Specifically, in a first zone 842 at and adjacent the base of the latch bolt, the slope of the blocking surface 840 is zero. As such, if the strike plate engages the latch bolt when the latch bolt is not being actuated, there will be no axially-directed force component that could urge the latch bolt to the withdrawn. The second zone 844 of the embodiment illustrated in FIG. 22 is inclined relative to the axis. As such, when the latch bolt engages the strike plate in the second zone 844, forces applied by the strike plate will have an axially-directed force component to help reduce friction and/or help urge the latch bolt to be withdrawn With reference next to FIG. 23, another embodiment is illustrated in which the blocking surface 850 of the latch bolt has a first and a second zone 852, 854. In the illustrated embodiment, the first zone 852, which is disposed at or adjacent the base of the latch bolt, has a first slope relative to the axis, and the second zone 854 has a second slope relative to the axis. The second slope 854 is greater than the first slope 852. Still other embodiments may employ three or more zones on a latch bolt blocking surface. Such zones may flat, inclined, arcuate, or combinations of such features.

FIGS. 19-23 have depicted latch bolt assemblies without dead latches. It is to be understood, however, that embodiments having features as discussed in connection with FIGS. 19-23 can also employ dead latches of various configurations. For example, such embodiments could employ structure as associated with the dead latch trigger 554 and dead latch 610 described above.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A lockset, comprising:

a retractor assembly configured to be fit within a mount hole of a door;

a latch bolt assembly comprising a latch bolt and a housing, the latch bolt being biased relative to the housing so that a distal portion of the latch bolt extends out of the housing when the latch bolt is in an at-rest position;

a retractor of the retractor assembly configured to be operably coupled to the latch bolt so that when the retractor is actuated to move from an unactuated position to an actuated position the latch bolt is retracted from the at-rest position into the housing of the latch bolt assembly; and an actuator mechanism operatively coupled to a handle, the actuator mechanism configured to actuate the retractor upon receiving an actuating input from the handle;

wherein the distal portion of the latch bolt comprises a blocking surface configured to engage an edge of a door strike plate when the door is in a closed position so as to block the door from opening; and wherein a first portion of the blocking surface has a first slope relative to an axis of the latch bolt, and a second portion of the blocking surface has a second slope relative to the axis of the latch bolt, the first slope being greater than zero, the second slope being greater than the first slope.

2. The lockset as in claim 1, wherein an arcuate part of the blocking surface is arcuate relative to the axis, and the first portion and second portion are within the arcuate part.

3. The lockset as in claim 2, wherein a slope of the blocking surface relative to the axis in the arcuate part increases moving toward a distal tip of the latch bolt.

4. The lockset as in claim 3, wherein a proximal portion of the blocking surface has a slope of zero relative to the axis.

5. The lockset as in claim 1, wherein at least one of the first portion and the second portion of the blocking surface is elongated and flat.

6. The lockset as in claim 5, wherein the other of the first portion and second portion of the blocking surface is arcuate.

7. The lockset as in claim 1, wherein the second portion is disposed between the first portion and a distal tip of the blocking surface.

8. The lockset as in claim 1, wherein the latch bolt assembly further comprises a dead latch assembly configured to selectively prevent the latch bolt from being retracted into the housing, the dead latch assembly being configured to be in an engaged position when the door is in the closed position, the dead latch assembly configured to remain in the engaged position as the retractor is actuated to move from an unactuated position to a threshold position so that the latch bolt is not retracted as the retractor moves from the unactuated position to the threshold position.

9. The lockset as in claim 8, wherein the dead latch assembly is further configured to move toward a disengaged position once the retractor moves past the threshold position so that the latch bolt is retracted with the retractor as the retractor moves from the threshold position towards the actuated position.

10. The lockset as in claim 9 additionally comprising a lock actuator within the retractor assembly, the lock actuator movable between a locked position and an unlocked position, the retractor assembly configured so that when the lock actuator is in the locked position the retractor is constrained between the unactuated position and a lock limited position.

11. The lockset as in claim 10, wherein a distance between the unactuated position and the threshold position is greater than the distance between the unactuated position and the lock limited position.

12. The lockset as in claim 1, wherein the actuator mechanism is configured to actuate the retractor upon receiving a rotational actuating input from the handle when the handle is rotated.

13. The lockset as in claim 12, wherein the actuator mechanism is further configured to actuate the retractor upon receiving an axially-directed actuating input that is directed along an axis of the actuator mechanism.

14. The lockset as in claim 13, wherein the axially-directed actuating input is communicated from the handle to the actuator mechanism.

15. The lockset as in claim 14, wherein the handle comprises a lever.

16. The lockset as in claim 1, wherein the actuator mechanism is configured to actuate the retractor upon receiving an axially-directed actuating input that is directed along an axis of the actuator mechanism.

17. The lockset as in claim 16, configured so that the axially-directed actuating input is communicated to the actuator mechanism when a pushing force is applied to the handle in a direction transverse to the latch bolt axis.

18. The lockset as in claim 1, wherein the actuator mechanism is configured to actuate the retractor upon receiving an input that is directed transverse to an axis of the actuator mechanism.

19. The lockset as in claim 18, wherein the handle comprises a lever.

20. The lockset as in claim 1, wherein the handle comprises a lever, and wherein the actuating input is communicated from the handle to the actuator mechanism when a pushing force is applied to the lever in a direction transverse to the latch bolt axis.

21. The lockset as in claim 20, configured so that the pushing force urges the blocking surface against the edge of the door strike plate.

* * * * *